US010208451B2

(12) United States Patent
Mori et al.

(10) Patent No.: US 10,208,451 B2
(45) Date of Patent: Feb. 19, 2019

(54) WORK VEHICLE AND FRONT LOADER

(71) Applicant: Kubota Corporation, Osaka-shi (JP)

(72) Inventors: Akihiko Mori, Sakai (JP); Masataka Takagi, Sakai (JP); Takahiro Yonekura, Sakai (JP); Masaki Abe, Sakai (JP)

(73) Assignee: Kubota Corporation, Osaka (JP)

( * ) Notice: Subject to any disclaimer, the term of this patent is extended or adjusted under 35 U.S.C. 154(b) by 30 days.

(21) Appl. No.: 15/332,328

(22) Filed: Oct. 24, 2016

(65) Prior Publication Data

US 2017/0114517 A1 Apr. 27, 2017

(30) Foreign Application Priority Data

Oct. 26, 2015 (JP) ..... 2015-210118
Dec. 7, 2015 (JP) ..... 2015-238816

(51) Int. Cl.

| | |
|---|---|
| ***E02F 3/40*** | (2006.01) |
| ***E02F 3/34*** | (2006.01) |
| ***E02F 3/36*** | (2006.01) |
| ***E02F 3/627*** | (2006.01) |

(52) U.S. Cl.

CPC ..... *E02F 3/40* (2013.01); *E02F 3/34* (2013.01); *E02F 3/3417* (2013.01); *E02F 3/3609* (2013.01); *E02F 3/6273* (2013.01)

(58) Field of Classification Search

CPC ..... E02F 3/40; E02F 3/3609; E02F 3/3417; E02F 3/34

See application file for complete search history.

(56) References Cited

U.S. PATENT DOCUMENTS

| | | | | |
|---|---|---|---|---|
| 5,540,289 | A | 7/1996 | Hirooka et al. | |
| 6,994,511 | B2 * | 2/2006 | Westendorf | E02F 3/3645 414/686 |
| 9,650,754 | B2 * | 5/2017 | Martinez | E02F 3/3627 |
| 2005/0111953 | A1 | 5/2005 | Westendorf et al. | |
| 2007/0292254 | A1 | 12/2007 | Mailleux | |
| 2014/0064899 | A1 | 3/2014 | Oyama et al. | |

FOREIGN PATENT DOCUMENTS

| | | | |
|---|---|---|---|
| DE | 20320795 | U1 | 4/2005 |
| FR | 2871485 | A1 | 12/2005 |
| GB | 2131391 | A | 6/1984 |
| GB | 2287930 | A | 4/1995 |
| JP | 2000110190 | A | 4/2000 |
| JP | 2010265674 | A | 11/2011 |
| JP | 20145690 | A | 1/2014 |

* cited by examiner

*Primary Examiner* — Ronald P Jarrett
(74) *Attorney, Agent, or Firm* — The Webb Law Firm

(57) ABSTRACT

A stand 18 is maintained under a stored posture when the stand 18 is pivoted toward the stored posture side in association with a dumping action of a bucket 13 and a lock mechanism 25 is switched to a locking state. The stand is switched to an in-use posture when the lock mechanism 25 is switched to a releasing state while the stand 18 is maintained under the stored posture by the lock mechanism 25.

8 Claims, 24 Drawing Sheets

WORK VEHICLE AND FRONT LOADER

CROSS-REFERENCE TO RELATED APPLICATIONS

This application claims priority to Japanese Patent Application Nos. 2015-210118 and 2015-238816, filed Oct. 26, 2015 and Dec. 7, 2015, respectively, the disclosures of which are hereby incorporated in their entirety by reference.

TECHNICAL FIELD

The present invention relates to a front loader attachable/detachable to/from a vehicle body and relates also to a work vehicle mounting the front loader.

BACKGROUND ART

A work vehicle described above includes a stand for supporting the front loader to allow it to stand on its own. For instance, a work vehicle disclosed in Patent Document 1 includes a stand supported to a front loader to be pivotable about a pivot axis ("a horizontal axis" in the document) extending along a vehicle body left-right direction between an in-use posture for supporting the front loader ("a supporting posture" in the document) and a stored posture ("a storage posture" in the document) along a longitudinal direction of a boom, a fixing pin for fixing the stand under the stored posture and a holding pin for fixing the stand under the in-use posture.

With the work vehicle disclosed in Japanese Unexamined Patent Application Publication No. 2000-110190 (Patent Document 1), when the stand is to be used, fixing of the stand to the stored posture is released and the posture of the stand is switched to the in-use posture, under which the stand is fixed by the holding pin. When the stand is to be stored, the fixing of the stand under the in-used posture is released and the stand is switched over to the stored posture, under which the stand is fixed by the fixing pin.

As another example of the above-described work vehicle, a work vehicle is known from e.g. Japanese Unexamined Patent Application Publication No. 2014-5690 (Patent Document 2). This work vehicle disclosed in Patent Document 2 includes a front loader that is attachable to and detachable from a vehicle body. In the work vehicle disclosed in Patent Document 2, the front loader is attached to the vehicle body by insertion of an attaching pin into a connecting pin hole provided in the front loader and an attaching pin hole provided in the vehicle body.

SUMMARY

With the work vehicle disclosed in Patent Document 1, for each occasion of switchover of the stand between the in-use posture and the stored posture, an operator needs to get off the driving section to carry out the above-described operation. Hence, this is troublesome.

In view of the above-described state of the art, there is a need for a front loader having a stand that can be easily switched over between an in-use posture and a stored posture as well as a need for a work vehicle having such front loader.

Further, with the work vehicle disclosed in Patent Document 2, attaching of the front loader to the vehicle body requires the above-described troublesome operation.

In view of the above-described state of the art, there is again a need for a front loader having a stand that can be easily switched over between an in-use posture and a stored posture as well as a need for a work vehicle having such front loader.

According to the present invention, a work vehicle comprises:

a front loader including a pair of left and right booms, a bucket supported to free ends of the pair of left and right booms to be pivotable about a pivot axis extending along a vehicle body left-right direction, the front loader being detachably attached to a vehicle body;

a stand pivotally supported to the front loader to be pivotable about a pivot axis extending along the vehicle body left-right direction between an in-use posture for supporting the front loader and a stored posture along a longitudinal direction of the booms, the stand being pivoted to the stored posture in association with a dumping motion of the bucket;

a lock mechanism switchable between a locking state for holding the stand under the stored posture and a releasing state for releasing the locking state; and an operational tool that can be manually operated from a driving section by a riding operator for switching over the lock mechanism to the locking state or the releasing state;

wherein when the stand is pivoted to the stored posture in association with the dumping motion of the bucket and the lock mechanism is switched to the locking state, the stand is held under the stored posture by the lock mechanism; and wherein when the lock mechanism is switched to the releasing posture by the operational tool while the stand is held under the stored posture by the locking mechanism, the stand is switched to the in-used posture.

With the above characterizing feature, when the stand is to be stored, the bucket will be dumped. Then, in association with this motion, the stand is pivoted toward the stored posture side. And, if the lock mechanism is switched to the locking state by a manual operation of the operational tool from the driving section, the stand is maintained under the stored posture by the lock mechanism. Also, when the stand is to be used, the lock mechanism is switched to the releasing state by a manual operation of the operational tool from the driving section, the stand is switched to the in-use posture. In this way, with the above-described characterizing feature, the stand can be switched over between the in-use posture and the stored posture without needing the operator's getting off the driving section. Moreover, since the stand is pivoted to the stored posture side in association with a dumping motion of the bucket, there are no need for a special actuator (e.g. a hydraulic cylinder, etc.) for pivoting the stand to the stored posture side or a control arrangement for controlling such actuator. Thus, costs can be suppressed.

Further, according to the present invention, preferably, an interlocking mechanism is provided for operatively interlocking the lock mechanism with the operational tool.

With the above characterizing feature, even if the operational tool is located distantly from the lock mechanism, operative interlocking can be established between the lock mechanism and the operational tool via the interlocking mechanism. This improves accessibility to the operational section from the driving section and also facilitates disposing of the operational section in the close proximity of the driving section.

Further, according to the present invention, preferably, the interlocking mechanism is disposed on a vehicle body lateral inner side of the booms.

With the above characterizing feature, the interlocking mechanism does not protrude to the vehicle body lateral outer side, thus presenting less obstacle.

Further, according to the present invention, preferably, a link mechanism between the booms and the stand is provided; and the link mechanism prevents the stand from being pivoted toward the stored posture side when the stand is under the in-use posture.

With the above characterizing feature, when the stand is under the in-use posture, there occurs no accidental pivotal movement thereof toward the stored posture side, so that the front loader can be firmly and reliably supported by the stand.

Further, according to the present invention, preferably, the link mechanism allows the stand to be pivoted toward the stored posture side in association with a dumping motion of the bucket.

With the above characterizing feature, the link mechanism does not inhibit the pivotal movement of the stand toward the stored posture side and the stand can be smoothly pivoted in association with a dumping motion of the bucket.

Further, according to the present invention, preferably, the lock mechanism includes an engaged portion provided in the stand and a hook supported to the booms to be pivotable about a pivot axis extending along the vehicle body left-right direction and engageable with the engaged portion.

With the above characterizing feature, the lock mechanism can be constituted of a simple arrangement consisting of the hook and the engaged portion. Further, as the hook is reliably supported to the booms which are highly rigid members, the pivotal posture of the hook can be stable.

Further, according to the present invention, preferably, a pivot axis of the bucket and a pivot axis of the stand are set on a same axis.

With the above characterizing feature, as the bucket and the stand are pivotally supported to a same member, commonization of the supporting components can be readily achieved.

According to the present invention, a front loader comprises:

a pair of left and right booms;

a bucket supported to free ends of the pair of left and right booms to be pivotable about a pivot axis extending along a vehicle body left-right direction, the front loader being detachably attached to a vehicle body;

a stand pivotally supported to the front loader to be pivotable about a pivot axis extending along the vehicle body left-right direction between an in-use posture for supporting the front loader and a stored posture along a longitudinal direction of the booms, the stand being pivoted to the stored posture in association with a dumping motion of the bucket;

a lock mechanism switchable between a locking state for holding the stand under the stored posture and a releasing state for releasing the locking state; and an operational tool that can be manually operated from a driving section by a riding operator for switching over the lock mechanism to the locking state or the releasing state;

wherein when the stand is pivoted to the stored posture in association with the dumping motion of the bucket and the lock mechanism is switched to the locking state, the stand is held under the stored posture by the lock mechanism; and when the lock mechanism is switched to the releasing posture by the operational tool while the stand is held under the stored posture by the locking mechanism, the stand is switched to the in-used posture.

With the above characterizing feature, when the stand is to be stored, the bucket will be dumped. Then, in association with this motion, the stand is pivoted toward the stored posture side. And, if the lock mechanism is switched to the locking state by a manual operation of the operational tool from the driving section, the stand is maintained under the stored posture by the lock mechanism. Also, when the stand is to used, the lock mechanism is switched to the releasing state by a manual operation of the operational tool from the driving section, the stand is switched to the in-use posture. In this way, with the above-described characterizing feature, the stand can be switched over between the in-use posture and the stored posture without needing the operator's getting off the driving section. Moreover, since the stand is pivoted to the stored posture side in association with a dumping motion of the bucket, there are no need for a special actuator (e.g. a hydraulic cylinder, etc.) for pivoting the stand to the stored posture side or a control arrangement for controlling such actuator. Thus, costs can be suppressed.

A work vehicle, according to the present invention, comprises:

a front loader that can be attached to or detached from a vehicle body; and an attaching mechanism for attaching the front loader to the vehicle body;

wherein the attaching mechanism includes an engaged member provided in the vehicle body and an engaging member provided in the front loader and engageable with the engaged member; and the attaching mechanism attaches the front loader to the vehicle body when the engaging member engages the engaged member.

With this characterizing feature, only with engagement of the engaging member to the engaged member, the front loader can be readily attached to the vehicle body. That is, the front loader can be attached to the vehicle body without using pins, bolts, etc., and the front loader can readily be detached from the vehicle body.

Further, in the present invention, preferably, the attaching mechanism includes a support member provided in the front loader and capable of supporting the engaged member; and the engaging member engages the engaged member while the engaged member is supported to the support member.

With the above characterizing feature, the engaging member comes into engagement with the engaged member while this engaged member is being supported to the support member. This allows the engaging member to engage the engaged member in a firm and reliable manner.

Further, in the present invention, preferably, an operational member is provided for switching the engaging member to an engaging position engaged with the engaged member or a non-engaging position not engaged with the engaged member.

With the above characterizing feature, with use of the operational member, the engaging member can be readily switched to the engaging position or the non-engaging position.

Further, in the present invention, preferably, the front loader further includes a pair of left and right booms that support an implement and a pair of left and right side frames that support base end portions of the booms to be pivotable about a pivot axis extending along the vehicle body left-right direction and that can be detachably attached to the vehicle body; and the operational member is accommodated within the side frames and can be manually operated from a driving section n which an operator rides.

With this characterizing feature, the engaging member can be readily switched over between the engaging position and the non-engaging position by a manual operation of the operational member from the driving section without needing the operator's getting off the driving section.

A front loader according to the present invention, detachably attached to a vehicle body;

wherein:

an attaching mechanism is provided for attaching the front loader to the vehicle body;

the attaching mechanism includes an engaging member engageable with an engaged member provided in the vehicle body; and the attaching member attaches to the front loader to the vehicle body with engagement of the engaging member with the engaged member.

With the above characterizing feature, only with engagement of the engaging member to the engaged member, the front loader can be readily attached to the vehicle body. That is, the front loader can be attached to the vehicle body without using pins, bolts, etc., and the front loader can readily be detached from the vehicle body.

EMBODIMENT

Next, an embodiment of the present invention will be explained with reference to the drawings. It is noted that in the following discussion, a direction of arrow F represents "a vehicle body front side", a direction of arrow B represents "a vehicle body rear side", respectively in the illustrations of FIGS. 1 and 2, and a direction of arrow L represents "a vehicle body left side" and a direction of arrow R represents "a vehicle body right side", respectively in the illustration of FIG. 2.

[General Arrangement of Tractor]

Figure 1:
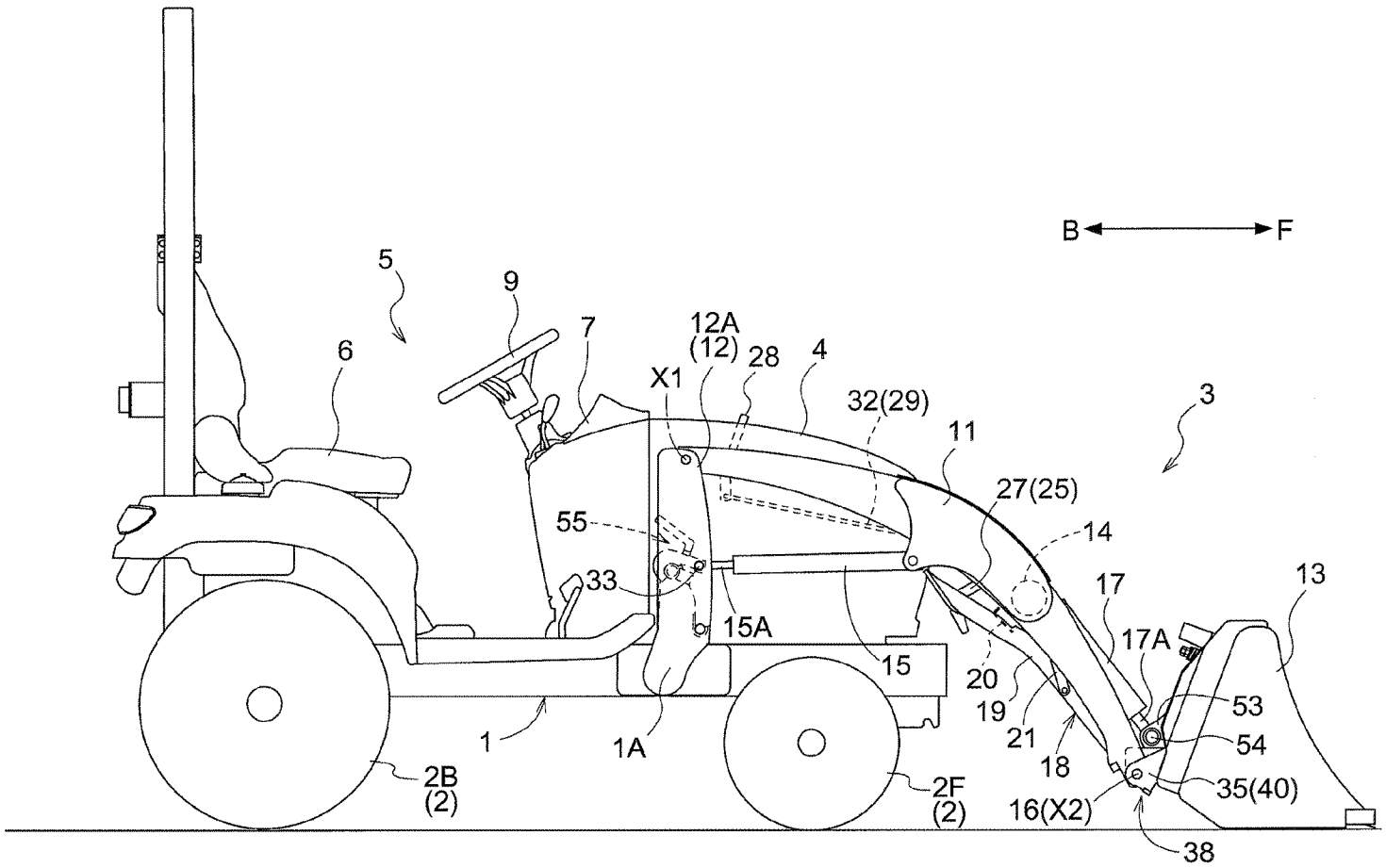
FIG. 1 is a right side view showing a tractor.
Figure 2:
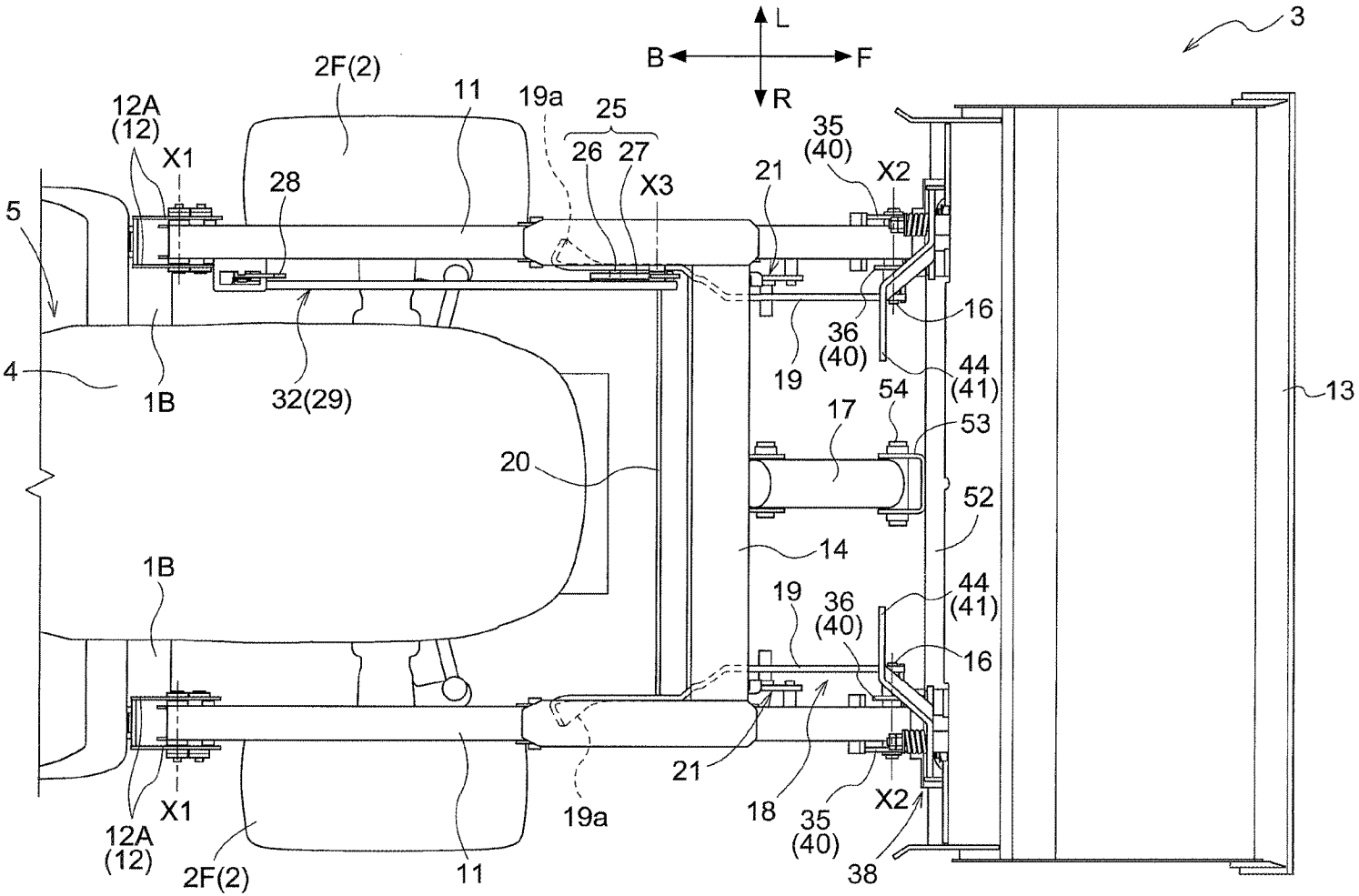
FIG. 2 is a plane view showing a front portion of the tractor.

FIG. 1 and FIG. 2 show a tractor (corresponding to "a work vehicle" relating to the present invention) including a front loader 3 equipped with a stand 18. This tractor includes a vehicle body frame 1 and a wheel type traveling device 2 supporting the vehicle body frame 1. The traveling device 2 includes a pair of left and right front wheels 2F and a pair of left and right rear wheels 2B.

Forwardly of the vehicle body, the front loader 3 is provided. The front loader 3 is detachably attached to the vehicle body. At a left side portion and a right side portion of the vehicle body frame 1, there are respectively provided attaching frames 1A capable of attaching the front loader 3. Each attaching frame 1A is provided on a vehicle body lateral outer end portion of a connecting tube 1B which protrudes to the vehicle body lateral outer side from the vehicle body frame 1. In a front half portion of the vehicle body frame 1, a hood 4 is provided. Inside this hood 4, an engine (not shown) is accommodated.

In a rear half portion of the vehicle body frame 1, there is provided a driving section 5 at which an operator rides. The driving section 5 includes a driver's seat 6, a front panel 7, etc. The front panel 7 includes a steering wheel 9.

[Front Loader]

The front loader 3 includes a pair of left and right booms 11, a pair of left and right side frames 12, and a bucket 13 (corresponding to "an implement" relating to the present invention). The pair of left and right brooms 11 each extends from the left or right side of the hood 4 to a position forwardly of the vehicle body. The pair of left and right booms 11 are connected via a connecting pipe 14 that extends along a vehicle body left-right direction. The booms 11 are connected to upper end portions of the side frames 12 to be pivotable about a pivot axis X1 that extends along the vehicle body left-right direction. Between the booms 11 and the side frames 12, there are provided hydraulic cylinders 15 for pivotally driving the booms 11.

The side frames 12 are detachably attached to an attaching frame 1A. To the side frames 12, a rod 15A side end of the hydraulic cylinder 15 is supported via a mount pin 33. The side frames 12 include a pair of left and right side plates 12A.

The bucket 13 is supported to free ends of the booms 11 via a support shaft 16 to be pivotable about a pivot axis X2 that extends along the vehicle body left-right direction. At a left end portion and a right end portion in the rear portion of the bucket 13 respectively, there are provided an outer connecting plate 33 and an inner connecting plate 36 that are to be connected to the support shaft 16. The outer connecting plate 35 and the inner connecting plate 36 bind therebetween the free ends of the booms 11 from the left and right opposed sides thereof. Between the bucket 13 and the connecting pipe 14, there is provided a hydraulic cylinder 17 for pivotally driving the bucket 13.

[Stand]

Figure 3:
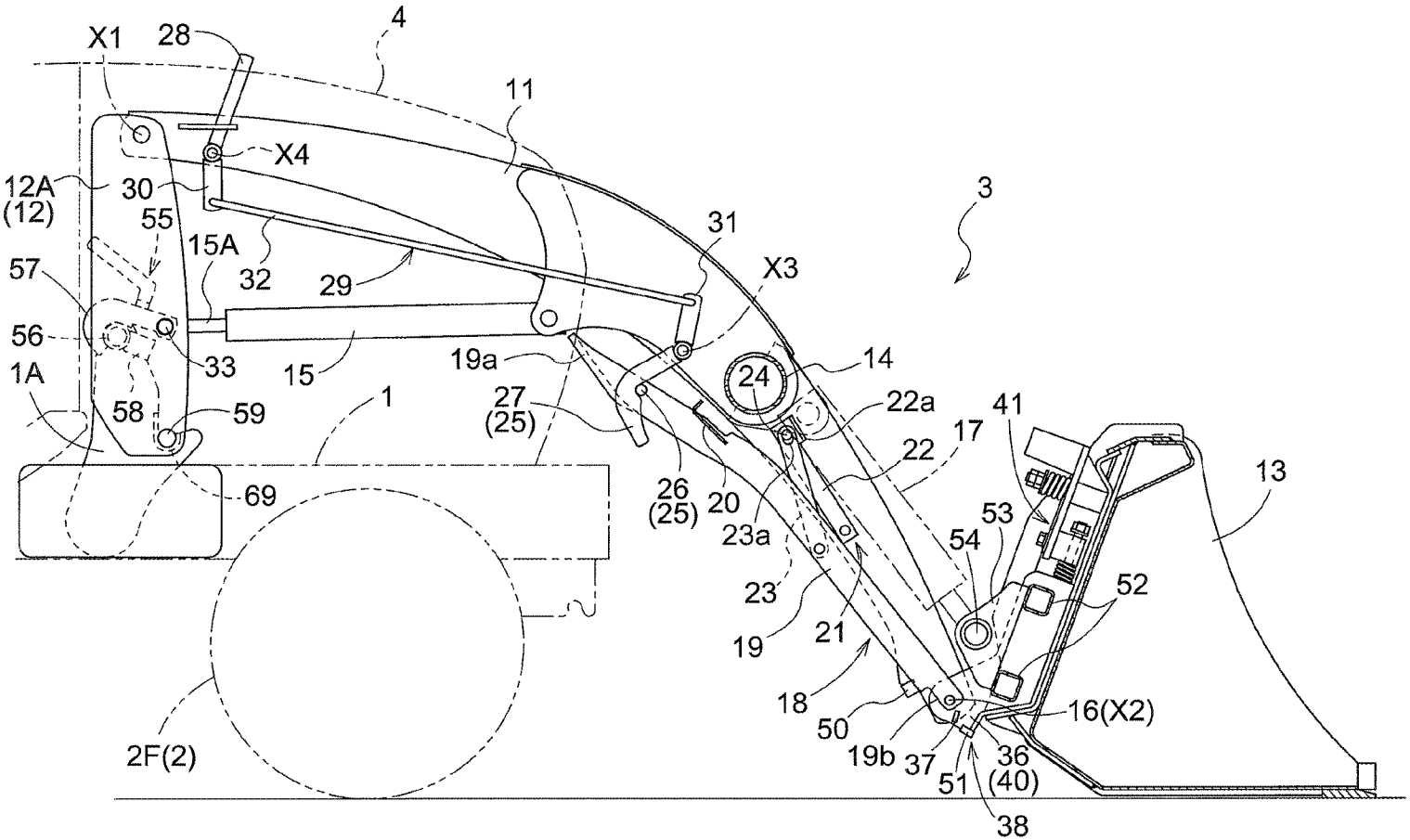
FIG. 3 is a right side view in section showing the front loader when attached to a vehicle body.

As shown in FIG. 2 and FIG. 3, this tractor includes a stand 18 supporting the front loader 3 in such a manner that the front loader 3 can stand on its own when this front loader 3 is to be attached or detached. The stand 18 is supported to the support shaft 16 to be pivotable about the pivot axis X2 between an in-use posture (see FIG. 4) for supporting the front loader 3 and a stored posture (see FIG. 3) along the longitudinal direction of the booms 11. Namely, the pivot axis X2 of the bucket 13 is set coaxial with the pivot axis X2 of the stand 18.

The stand 18 includes a pair of left and right stand bodies 19. The pair of left and right stand bodies 19 are connected via a connecting frame 20 extending along the vehicle body left-right direction to be pivoted in association with each other. The pair of left and right stand bodies 19 respectively are positioned on the vehicle body lateral inner sides of the left boom 11 and the right boom 11. Incidentally, the stand 18 need not be disposed on a same axis as the bucket 13. But, with the coaxial arrangement above, no separate rotational shaft portion needs to be provided; and moreover, with use of the shaft having sufficient strength, the stand 18 can be formed stronger.

The stand body 19 is bent at its longitudinal intermediate portion with its free end side being disposed on the vehicle body lateral outer side relative to its base end side so that in the vehicle body left-right direction, a distance between the free ends of the pair of left and right stand bodies 19 may be longer than a distance between the base ends of the pair of left and right stand bodies 19. The free end of the stand body 19 is overlapped with the corresponding boom 11 as seen in a plane view (see FIG. 2). At the free end of the stand body 19, there is formed a ground contacting portion 19*a* having a wide width. With the above-described arrangement, the front loader 3 can be supported by the stand 18 in a reliable and firm manner without wobble in the vehicle body left-right direction.

[Link Mechanism]

Between the boom 11 and the stand body 19 corresponding thereto, a link mechanism 21 is provided. This link mechanism 21 is positioned between the boom 11 and the stand body 19 in the vehicle body left-right direction. The link mechanism 21 includes a first link member 22 on the boom 11 side and a second link member 23 on the stand boy 19 side. The first link member 22 and the second link member 23 are connected to be pivotable relative to each other via a connecting shaft 24. Of the second link member 23, at an end thereof on the first link member 22 side, there is formed an elongate hole 23*a* in which the connecting shaft 24 is to be inserted.

[Stand Lock Mechanism]

A stand lock mechanism 25 is provided that is switchable between a locking state for holding (locking) the stand 18 under the stored posture and a releasing state for releasing this locking. In the instant embodiment, the stand lock mechanism 25 is provided between the left stand body 19 and the left boom 11. The stand lock mechanism 25 includes a pin 26 and a hook 27 engageable with the pin 26. The pin 26 is provided at the free end of the left stand body 19 in such a manner to protrude to the vehicle body lateral inner side. The hook 27 is supported to vehicle body lateral inner side of the left boom 11 to be pivotable about a pivot axis X3 extending along the vehicle body left-right direction between an engaging position to be engaged with the pin 26 and a non-engaging position not to be engaged with the pin 26. The hook 27 is disposed at a longitudinal intermediate portion of the left boom 11. More particularly, the hook 27 is disposed in the left boom 11 at a position thereof between the portion of the boom 11 connected to the hydraulic cylinder 15 and the portion of the same connected to the connecting pipe 14.

[Stand Operational Lever]

A stand operational lever 28 is provided which can be manually operated from the driving section 5 and which is operable to switch over the stand lock mechanism 25 between the locking state and the releasing state. The stand operational lever 28 is switchable between a locking position corresponding to the engaging position of the hook 27 and a releasing position corresponding to the non-engaging position of the hook 27. The stand operational lever 28 is supported to the vehicle body lateral inner side portion of the left boom 11 to be pivotable about a pivot axis X4 that extends along the vehicle body left-right direction. The stand operational lever 28 is disposed at the free end portion of the left boom 11. More particularly, the stand operational lever 28 is disposed rearwardly and upwardly of the rotational axis of the front wheel 2F.

[Interlocking Mechanism]

An interlocking mechanism 29 is provided for interlocking the stand lock mechanism 25 and the stand operational lever 28 to each other. The interlocking mechanism 29 is disposed on the vehicle body lateral inner side of the left boom 11. This interlocking mechanism 29 includes a first arm 30 on the stand operational lever 28 side, a second arm 31 on the hook 27 side, and a linking rod 32 extending between the first arm 30 and the second arm 31. The first arm 30 is pivotable together with the stand operational lever 28. The second arm 31 is pivotable together with the hook 27.

[Posture Switchover of Stand]

Figure 4:
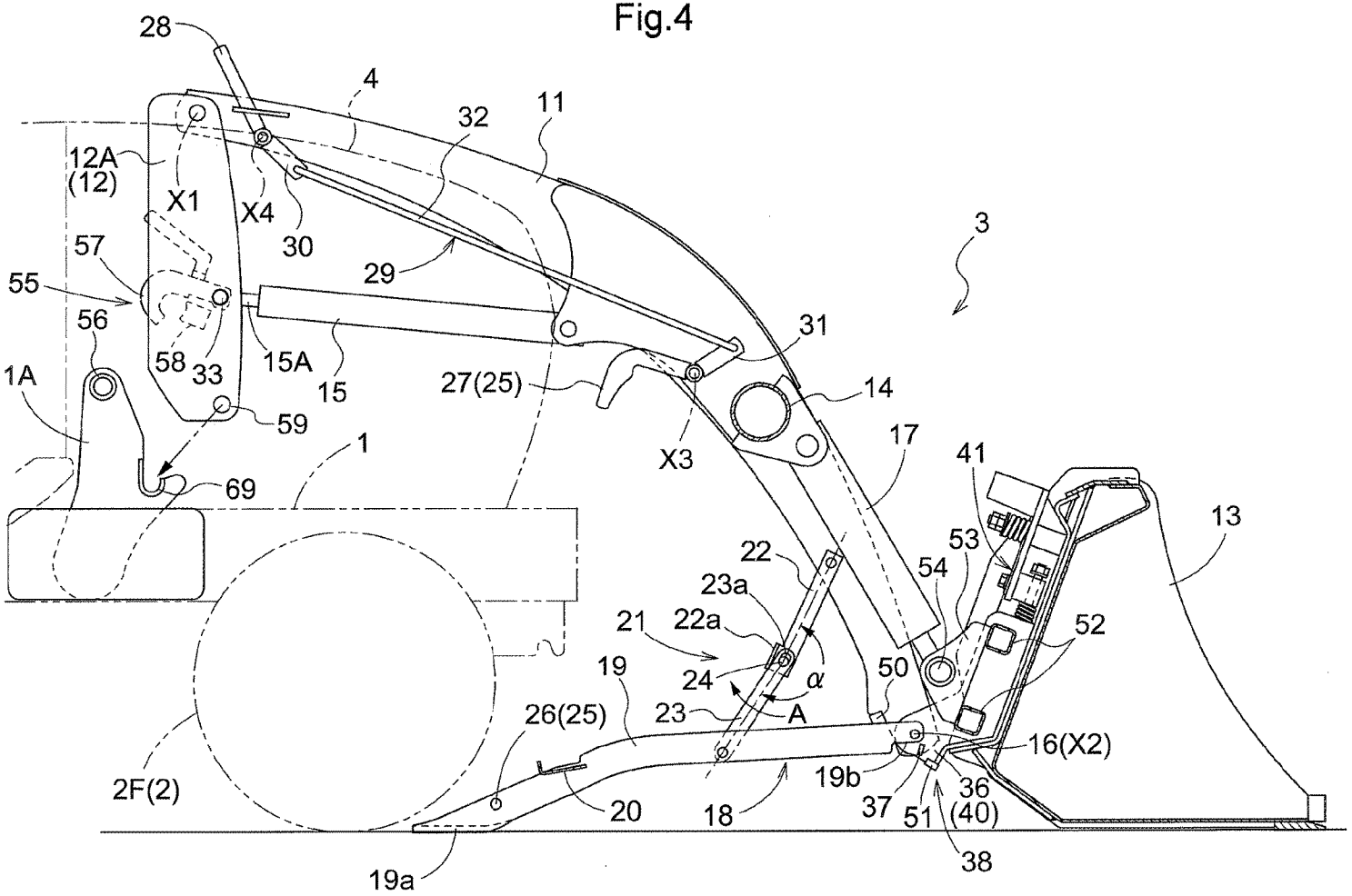
FIG. 4 is a right side view in section showing the front loader when supported to a stand.

As shown in FIG. 4, when the front loader 3 is not attached to the vehicle body, in order to allow this front loader 3 to stand on its own, the stand 18 is switched to the in-use posture. Then, after causing the vehicle body to travel forwardly and connecting the vehicle body and the front loader 3 via a hydraulic hose (not shown), the front loader 3 can be attached to the attaching frame 1A. Incidentally, this tractor includes a pair of left and right attaching mechanisms 55 for attaching the front loader 3 to the vehicle body. This arrangement will be explained in greater details later herein.

Here, at a second link member 23 side end portion of the first link member 22, there is provided a contact portion 22*a* that can come into contact with the second link member 23.

And, when the stand 18 is under the in-use posture, as the contact portion 22*a* comes into contact with the second link member 23, a pivotal motion of the second link member 23 toward its opening side (direction of arrow A shown in FIG. 4) is inhibited. Namely, the link mechanism 21 inhibits a pivotal movement of the stand 18 toward the stored posture side when the stand 18 assumes the in-use posture. In the state illustrated in FIG. 4, the first link member 22 and the second link member 23 are opened by an opening degree a which is slightly larger than 180 degrees.

Figure 5:
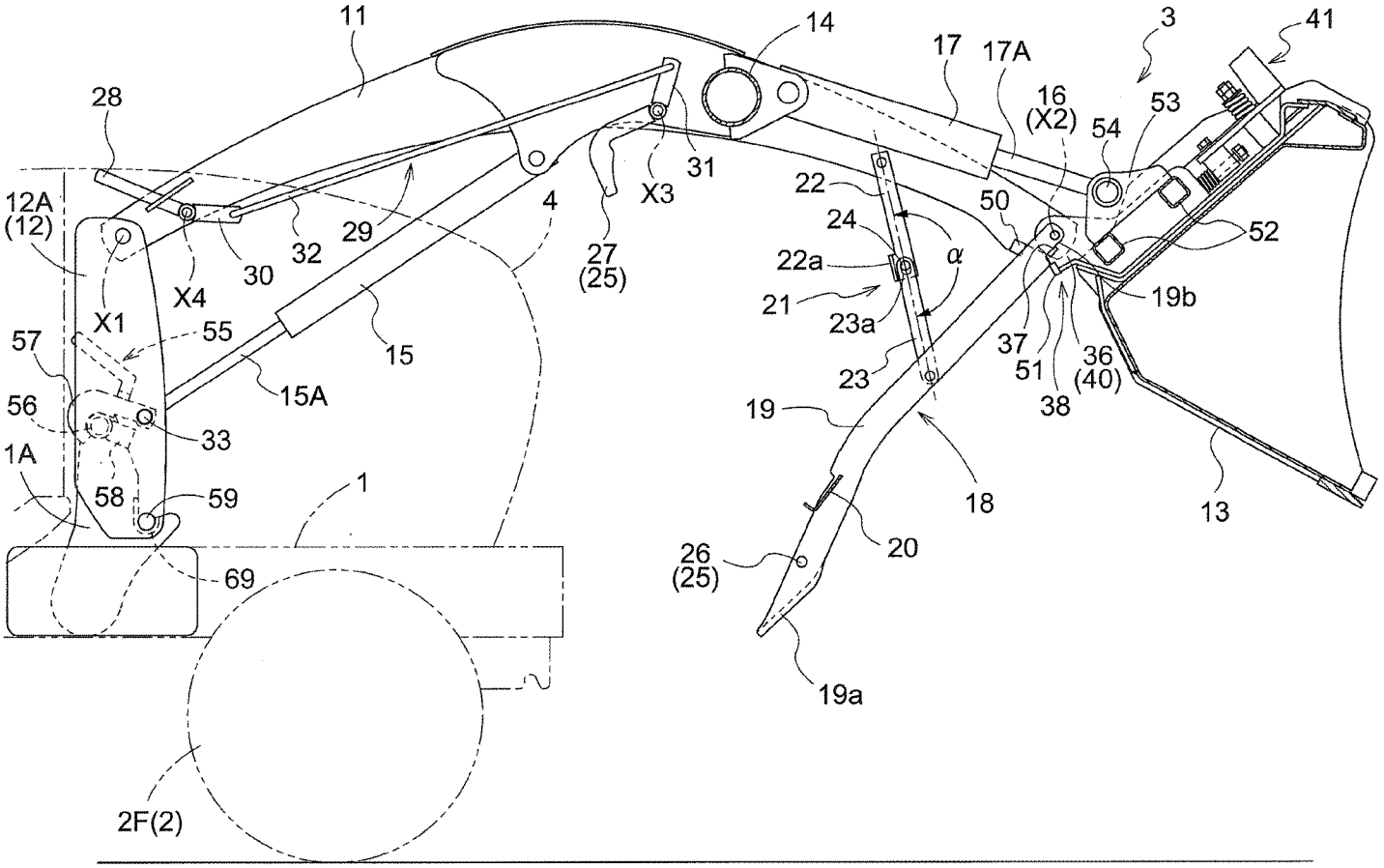
FIG. 5 is a right side view in section showing the front loader when booms are lifted up for causing a bucket to effect a dumping action up to a position contacting the stand.

In succession, as illustrated in FIG. 5, the booms 11 are lifted up to cause the bucket 13 to effect a dumping motion to a position contacting the stand 18.

More particularly, at the left end portion and the right end portion respectively in the rear portion of the bucket 13, the inner connecting plate 36 includes a projection 37 projecting to the vehicle body inner side. On the other hand, at the base end portion of the stand body 19, there is formed a recess 19*b* into which the projection 37 is to be fitted. With this, as the booms 11 are lifted up, the bucket 13 effects a dumping motion to the position where the projection 37 enters the recess 19*b* to come into contact with the base end portion of the stand body 19. In the instant embodiment, as the recess 19*b* is provided in the stand body 19, adjustment of pivotal range for the stand body 19 suitable for the dumping motion of the bucket 13 can be effected easily.

Figure 6:
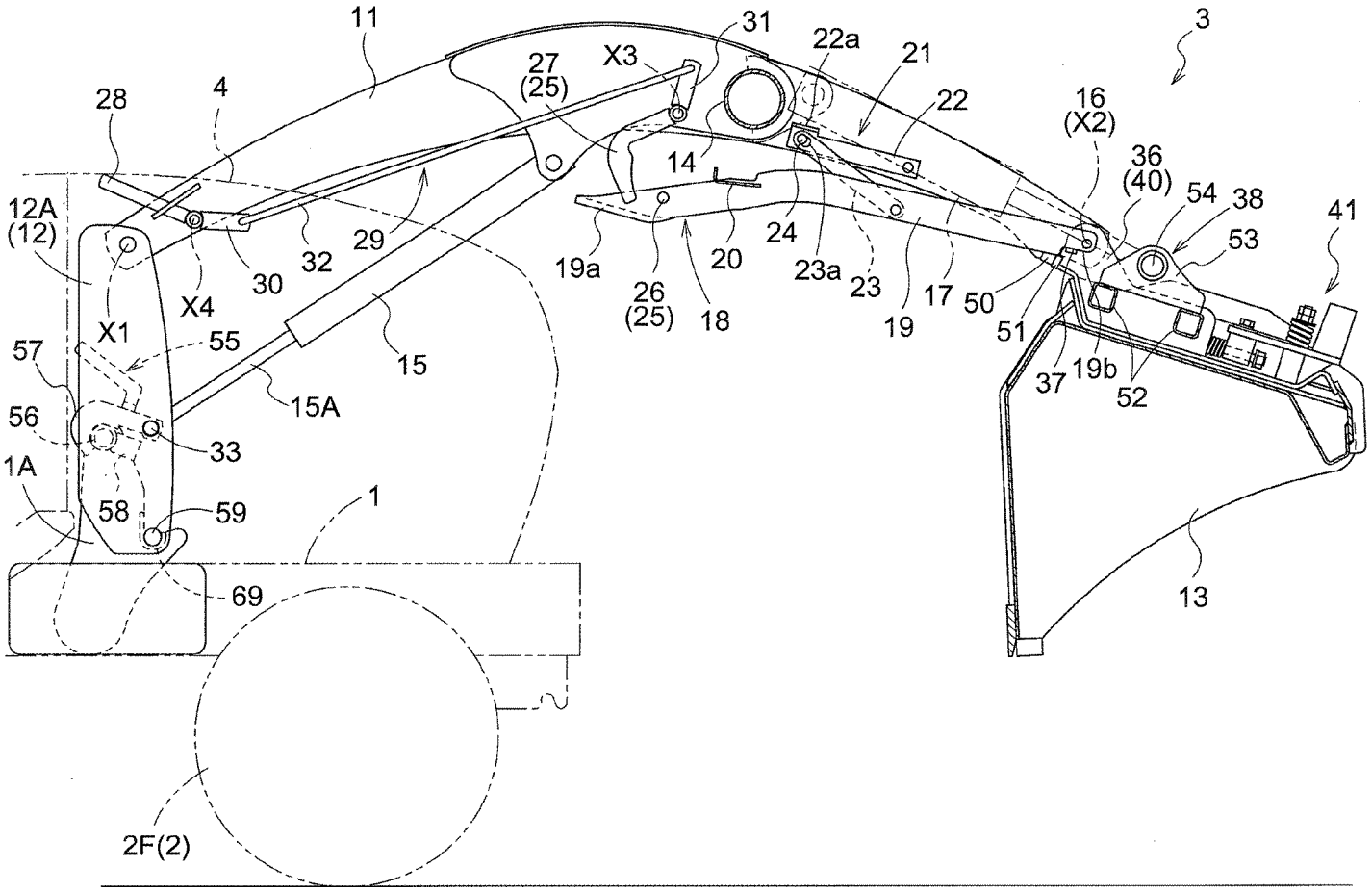
FIG. 6 is a right side view in section showing the front loader when the bucket is caused to effect a dumping action to a maximum dump position.

And, when the bucket 13 is further dumped with the projection 37 kept in contact with the base end portion of the stand body 19, as illustrated in FIG. 6, in association with the dumping motion of the bucket 13, the stand 18 is pivoted to the stored posture side.

Here, under the state illustrated in FIG. 5, when the bucket 13 is dumped, by an amount of movement of the second link member 23 through the elongate hole 23*a* along the connecting shaft 24, the length of the link mechanism 21 is reduced, whereby the second link member 23 is pivoted toward its closing side (the direction opposite the arrow A shown in FIG. 4). Namely, the link mechanism 21 allows the stand 18 to be pivoted toward the stored posture side in association with a dumping action of the bucket 13. And, when the bucket 13 is dumped to the maximum dumping position, the stand 18 assumes a state illustrated in FIG. 6.

Figure 7:
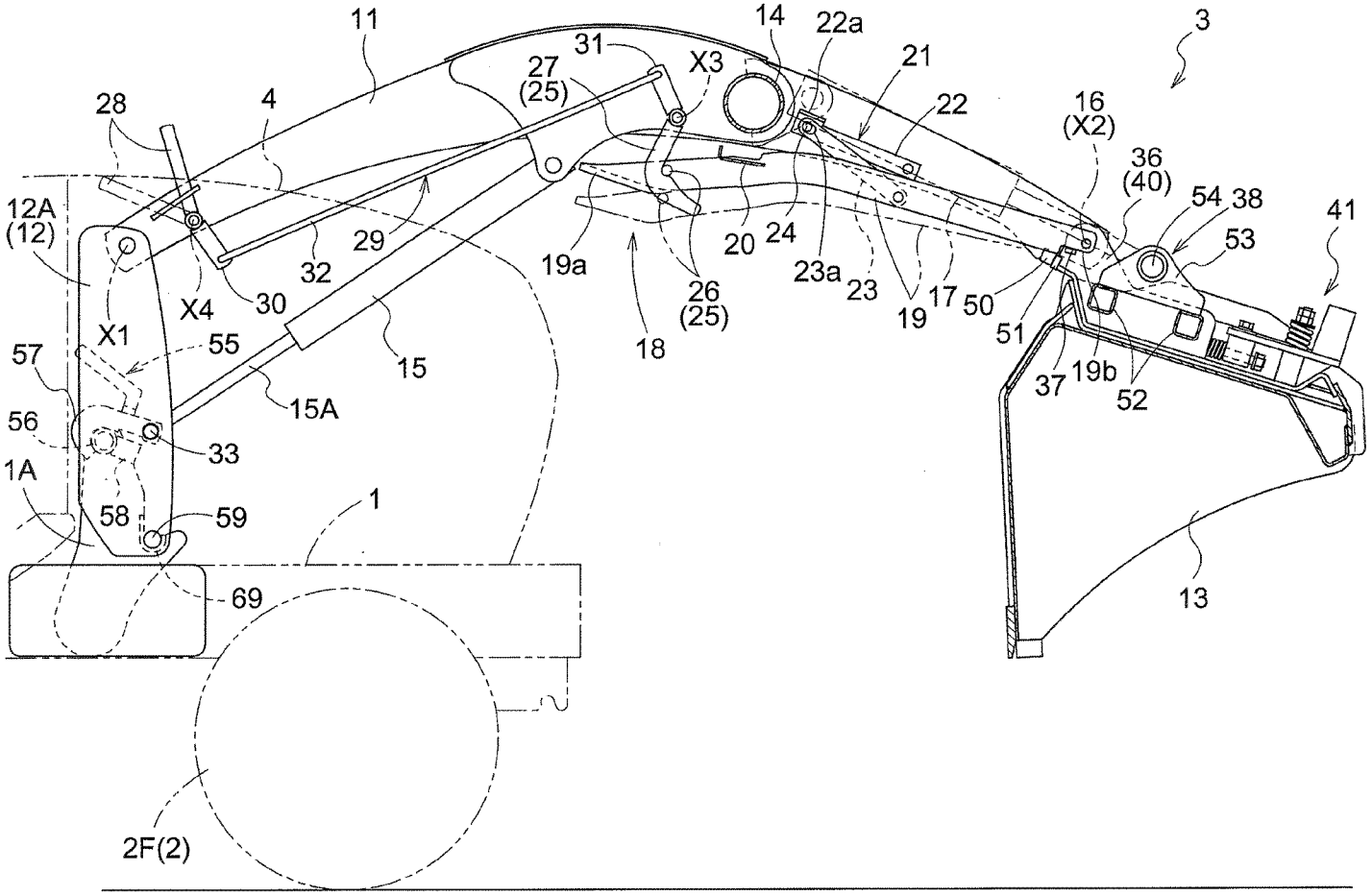
FIG. 7 is a right side view in section showing the front loader when the stand is stored.

Next, as shown in FIG. 7, if the stand operational lever 28 is switched to the locking position, via the interlocking mechanism 29, the hook 27 is operated in interlocking with the stand operational lever 28. With this, the hook 27 is switched to the engaging position.

Figure 8:
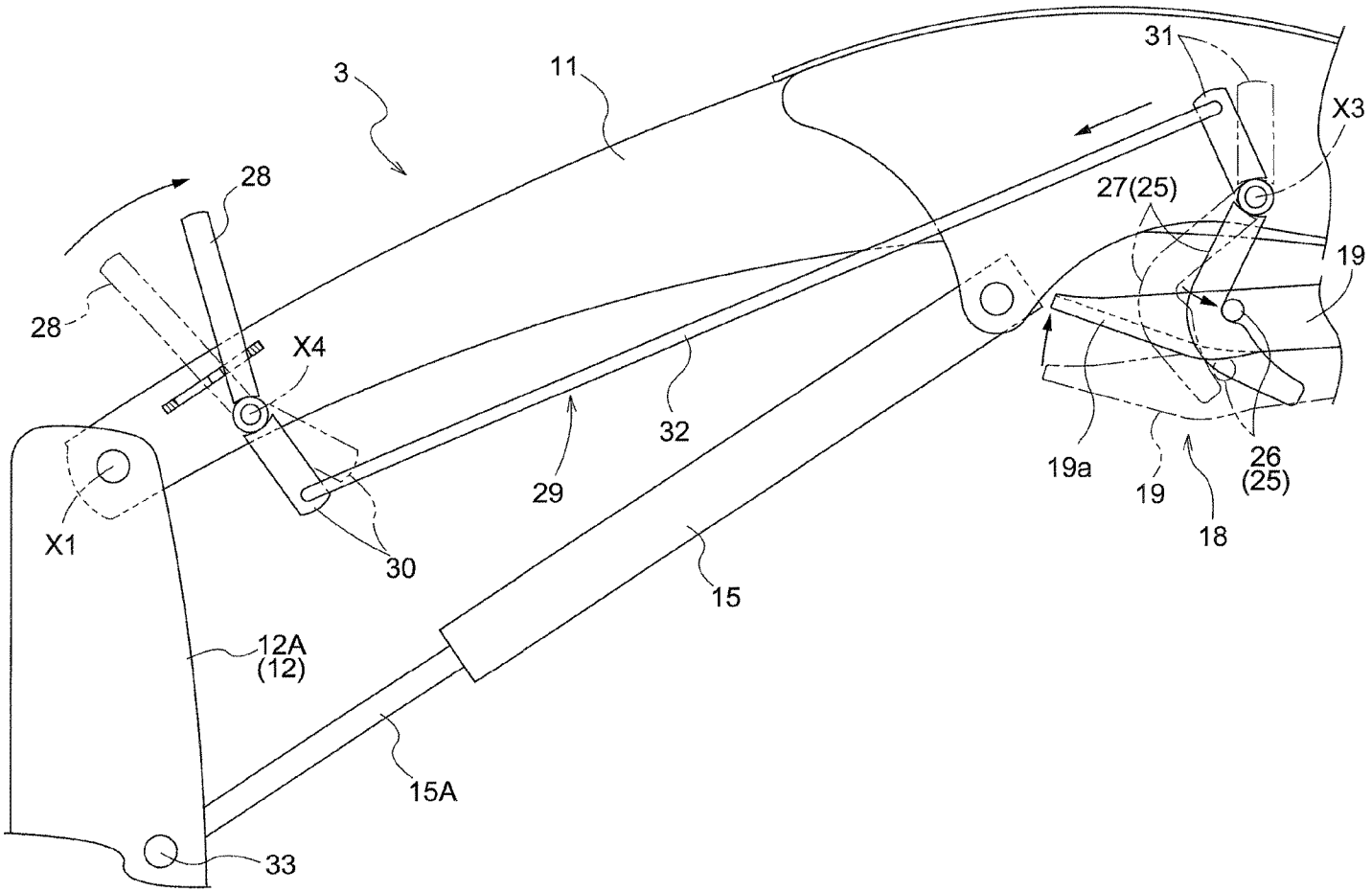
FIG. 8 is a right side view showing an interlocking mechanism.

In the above, as illustrated in FIG. 8, in association with the switchover of the hook 27 to the engaging position, the hook 27, via the pin 26, causes the stand 18 to be slightly lifted up to a position corresponding to the stored posture. With this, a slight gap is formed between the projection 37 and the base end portion of the stand body 19, so that under the stored posture of the stand 18, occurrence of contact or resultant wobbling will occur less likely between the projection 37 and the stand body 19 during a work. In this way, as the stand lock mechanism 25 is switched to the locking state by the stand operational lever 28, the stand 18 is maintained under the stored posture.

Further, by a reverse procedure to the above, the stand 18 can be switched to the in-use posture. Namely, as shown in FIG. 7, while the stand 18 is maintained under the stored posture by the stand lock mechanism 25, if the stand operational lever 28 is switched to the releasing position, the stand lock mechanism 25 is switched to the releasing state (see FIG. 6). With this, the stand 18 is slightly moved downwards to the position where base end portion of the stand 19 comes into contact with the projection 37.

And, when the bucket 13 is scooped, with the projection 37 kept in contact with the base end portion of the stand body 19, in association with the scooping motion of the bucket 13, the stand 18 is pivoted toward the in-use posture side. In this way, the stand 18 can be switched to the in-use posture.

[Bucket Attaching Frame]

Figure 9:
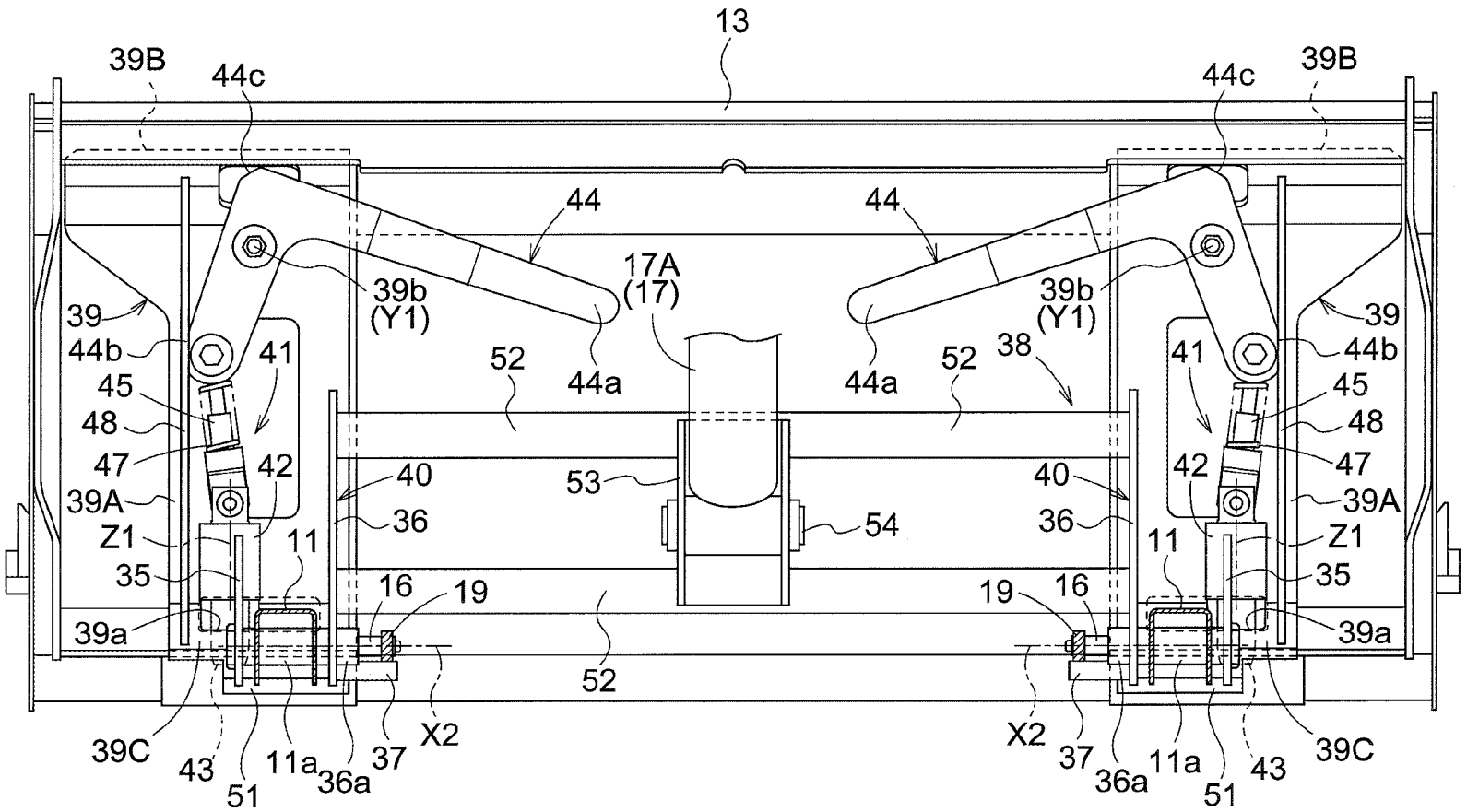
FIG. 9 is a rear view showing a state when the bucket is attached to an attaching frame.

As shown in FIG. 9, to the free end portions of the pair of left and right booms 11, a bucket attaching frame 38 is supported via the support shaft 16 to be pivotable about the pivot axis X2 extending along the vehicle body left-right direction. At the free end portion of the boom 11, there is provided a boss portion 11*a* through which the support shaft 16 is inserted. To the bucket attaching frame 38, the bucket 13 is detachably attached. The bucket attaching frame 38 includes a pair of left and right frame bodies 39 and a pair of left and right connecting portions 40.

[Bucket Lock Mechanism]

At rear portions of the frame bodies 39, there are provided a pair of left and right bucket lock mechanisms 41 capable of switching over the bucket 13 between a locking state to be fixed to the attaching frame 38 and a releasing state for releasing the lock. Each bucket lock mechanism 41 includes a frame boss member 42, a bucket lock pin 43 and an operational handle 44.

[Frame Boss Member]

Figure 10:
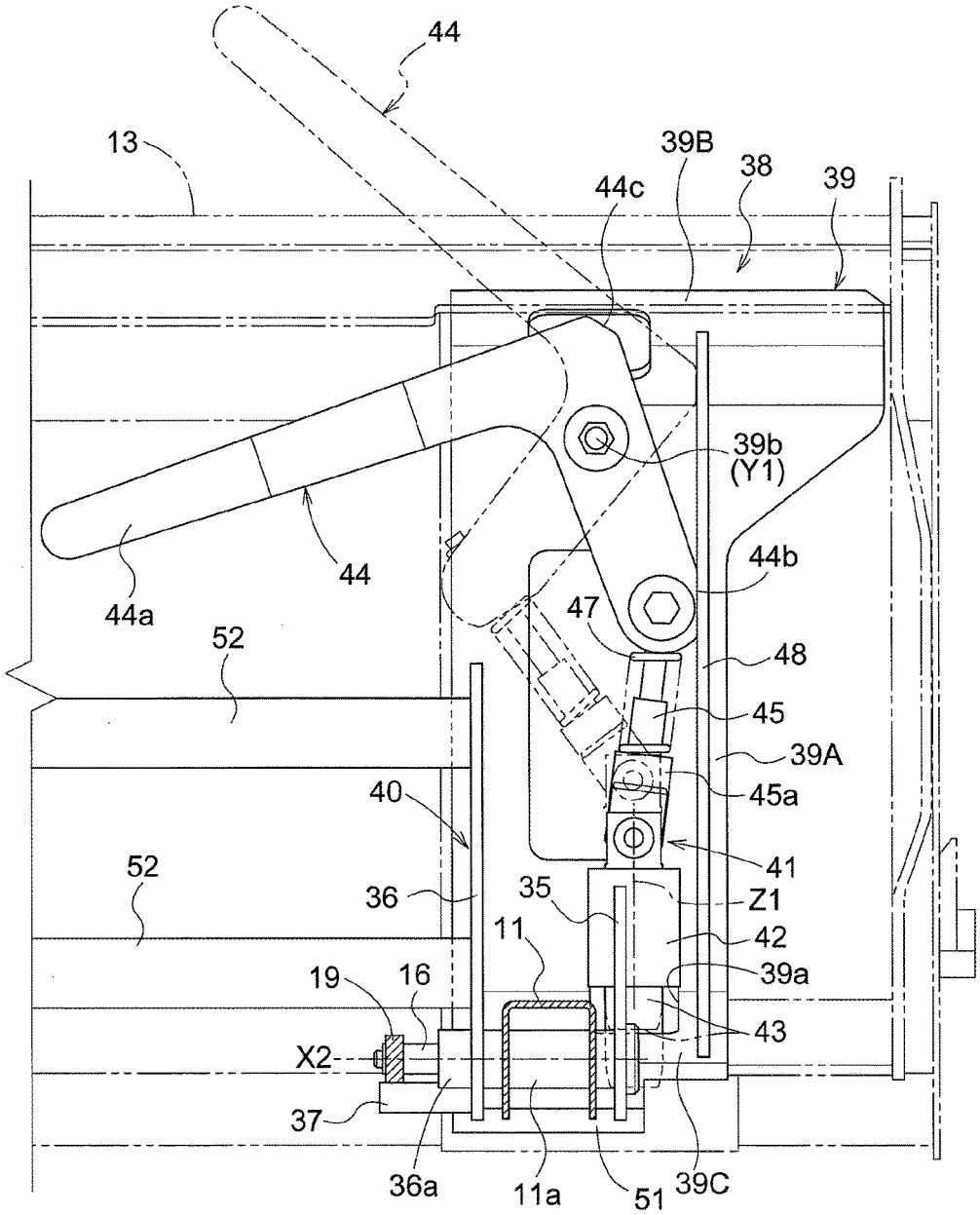
FIG. 10 is a rear view showing a lock mechanism and a connecting portion.
Figure 11:
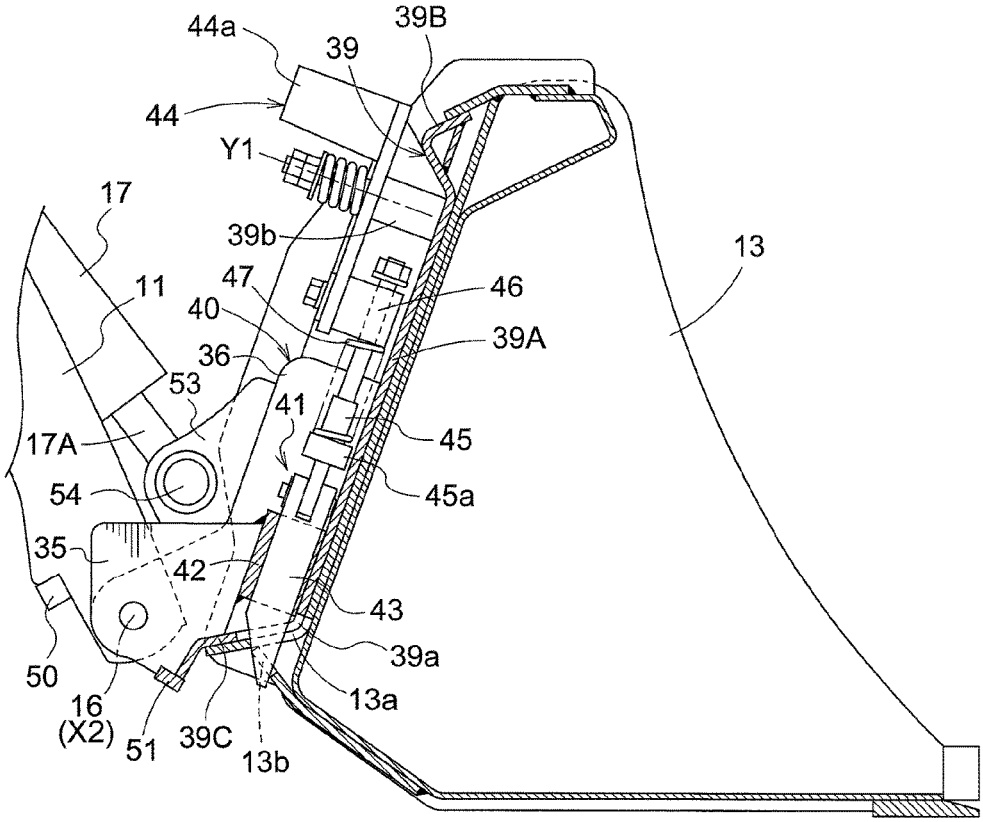
FIG. 11 is a right side view in section showing the lock mechanism and the connecting portion.
Figure 12:
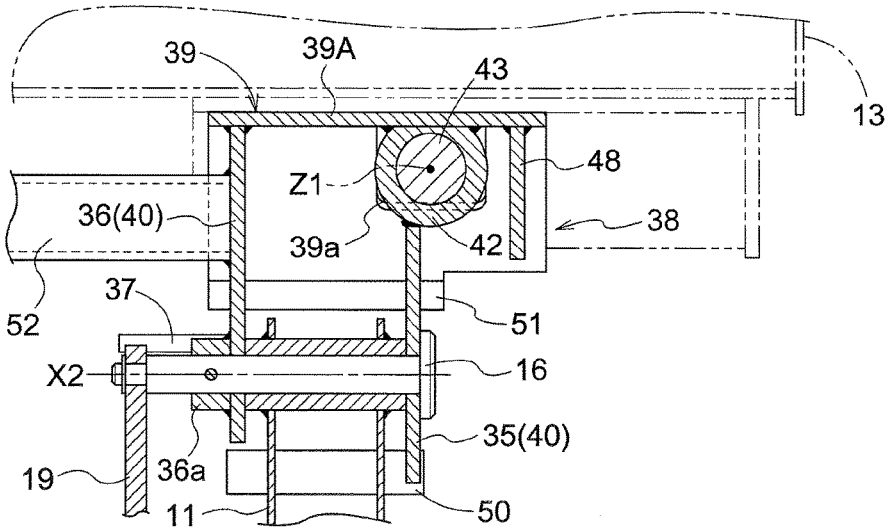
FIG. 12 is a section showing the lock mechanism and the connecting portion.

As shown in FIGS. 10 through 12, the frame boss member 42, as being positioned on more vehicle body lateral outer side than the frame 11 (the boss portion 11*a*), extends in the vertical direction along the rear face of the frame body 39. The frame boss member 42 is fixedly welded to the frame body 39.

[Bucket Lock Pin]

The bucket lock pin 43 is supported to the frame boss member 42 to be slidable between a locking position (the position shown by a solid line in FIG. 1) corresponding to the locking state and a releasing position (the position shown by a two-dotted chain line in FIG. 10) corresponding to the releasing state. The frame body 39 and the bucket 13 define locking holes 39*a*, 13,*a*, 13*b* through which the bucket lock pin 43 can be inserted.

To the upper end portion of the bucket lock pin 43, a link 45 is pivotally connected. The link 45 slidably supports a stopper 46. Between a receiving portion 45*a* of the link 45 located between and the stopper 46, a spring 47 is fitted.

[Operational Handle]

The operational handle 44 is supported to a support shaft 39*b* provided in the frame body 39 to be pivotable about a pivot axis Y1. One end portion of the operational handle 44 is bolt-fixed to the stopper 46. At the other end portion of the operational handle 44, a grip 44*a* is formed.

[Frame Body]

The frame body 39 includes a body portion 39A extending in the vertical direction along the rear face of the bucket 13, an upper attaching portion 39B which is formed at the upper end portion of the frame body 39 and to which an upper portion of the rear portion of the bucket 13 is to be attached and a lower attaching portion 39C which is formed at the lower end portion of the frame body 39 and to which the lower portion of the rear portion of the bucket 13 is to be attached. To the frame body 39, fixedly welded is a vertical plate 48 that extends in the vertical direction along the upper attaching portion 39B and the lower attaching portion 39C. The vertical plate 48 is located on more vehicle body lateral outer side than the frame boss member 42.

[Connecting Portion]

The connecting portion 40 includes an outer connecting plate 35 and an inner connecting plate 36. Between the outer connecting plate 35 and the inner connecting plate 36, there is provided a stopper 51 which can come into contact with a stopper 50 provided in the boom 11. In operation, during a dumping action of the bucket 13, as the stopper 51 provided on the connecting portion 40 side comes into contact with the stopper 50 provided on the boom 11 side, the bucket 13 is fixed at the maximum dumping position.

The outer connecting plate 35 is connected to a portion of the support shaft 16 which portion is disposed on the vehicle body lateral outer side of the boom 11 and projects to the vehicle body lateral outer side from the boom 11 (the boss portion 11*a*). The outer connecting plate 35, as being positioned on the vehicle body lateral inner side than the vehicle body lateral outer end of the frame boss member 42, is fixedly welded to the frame boss member 42 and the lower attaching portion 39C. More particularly, the outer connecting plate 35 is located on more vehicle body lateral inner side than an axis Z1 of the frame boss member 42 and on more vehicle body lateral outer side than the vehicle body lateral inner end of the frame boss member 42. That is, the outer connecting plate 35 is overlapped with the frame boss member 42 as seen in the rear view (see FIG. 10).

A vertical length of the outer connecting plate 35 is set shorter than a vertical length of the inner connecting plate 36. An upper end position of the outer connecting plate 35 is set lower than an upper end position of the frame boss member 42.

The inner connecting plate 35, as being located on the vehicle body lateral inner side of the frame 11, is connected to a portion of the boom 1 (boss portion 11*a*) which portion projects toward the vehicle body inner side. The inner connecting plate 36 is fixedly welded to the body portion 39A and the lower attaching portion 39C. The inner connecting plate 36 includes a boss portion 36*a* which supports the support shaft 16. The boss portion 36*a* projects from the inner connecting plate 36 toward the vehicle body lateral inner side.

The left inner connecting plate 36 and the right inner connecting plate 36 are connected to each other via two cross frames 52 that extend in the vehicle body left-right direction. Between the one cross frame 52 and the other cross frame 52, a support bracket 53 is provided. To the support bracket 53, a rod 17A side end portion of the hydraulic cylinder 17 is supported via a pin 54.

With the above-described arrangement, the outer connecting plate 35, as being located on more vehicle body lateral outer side than the vehicle body lateral outer end of the frame boss member 42, is connected to the frame boss member 42, in comparison with an arrangement of the outer connecting plate 53 being located on more vehicle body lateral outer side than the frame boss member 42, the distance between the outer connecting plate 35 and the inner connecting plate 36 in the vehicle body left-right direction can be small, so that the length of the support shaft 16 and also the length of the portion (e.g. the boss portion 36*a*) of the outer connecting plate 35 and the inner connecting plate that supports the support shaft 16 can be short, whereby the connecting arrangement between the bucket attaching frame 38 and the boom 11 can be formed compact and also the strength of the support shaft 16 or the boss portion 36*a* can be improved. Moreover, as the outer connecting plate 35 is supported to the frame boss member 42 having high rigidness, the outer connecting plate 35 can be supported reliably and firmly.

[Switchover of Bucket Lock Mechanism]

As shown in FIG. 10, when the operational handle 44 is pivotally operated to the position denoted by solid line in FIG. 10, the bucket lock pin 43 moves downwards along the frame boss member 42 to be inserted into the lock hole 39*a* on the frame body 39 side and lock holes 13*a*, 13*b* on the bucket 13 side. In the course of this, as a first contact portion 44*b* of the operational handle 44 comes into contact with the vertical plate 48, thus preventing the operational handle 44 from being pivoted any further. And, the operational handle 44 is maintained by the urging force of the spring 47 under the state of the first contact portion 44*b* being in contact with the vertical plate 48. In this way, the bucket lock mechanism 41 can be switched to the locking state.

And, when the operational handle 44 is pivoted to the position denoted with the two-dotted chain line in FIG. 10, the bucket lock pin 43 moves upward along the frame boss member 42 to come out of engagement from the lock hole 39*a* on the frame body 39 side and the lock holes 13*a*, 13*b* on the bucket 13 side. In the course of this, as a second contact portion 44*c* of the operational handle 44 comes into contact with the vertical plate 48, the operational handle 44 is inhibited from being pivoted any further. In this way, the bucket lock mechanism 41 can be switched to the releasing state.

[Attaching Mechanism for Front Loader]

Figure 13:
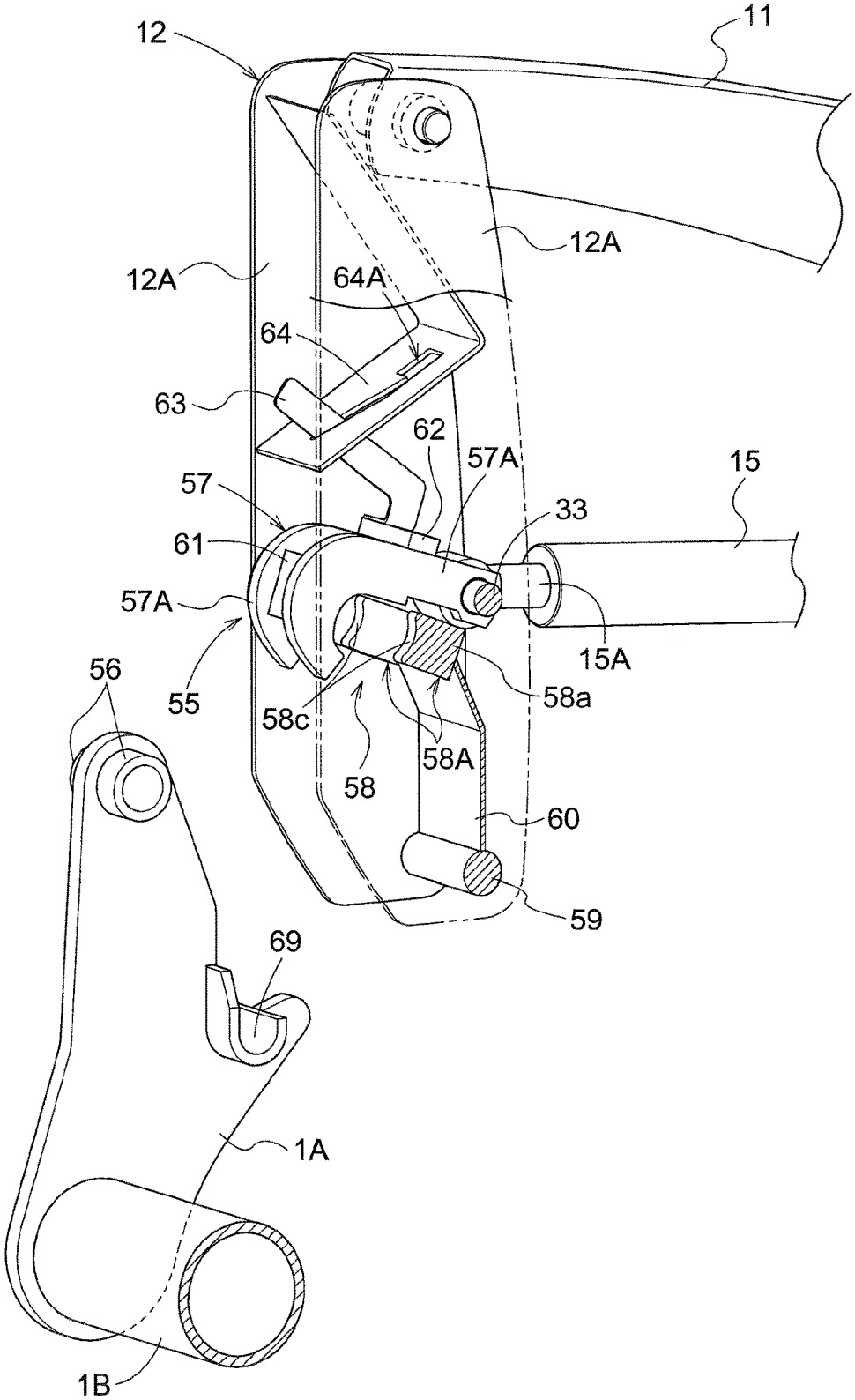
FIG. 13 is an exploded perspective view showing an attaching mechanism.
Figure 14:
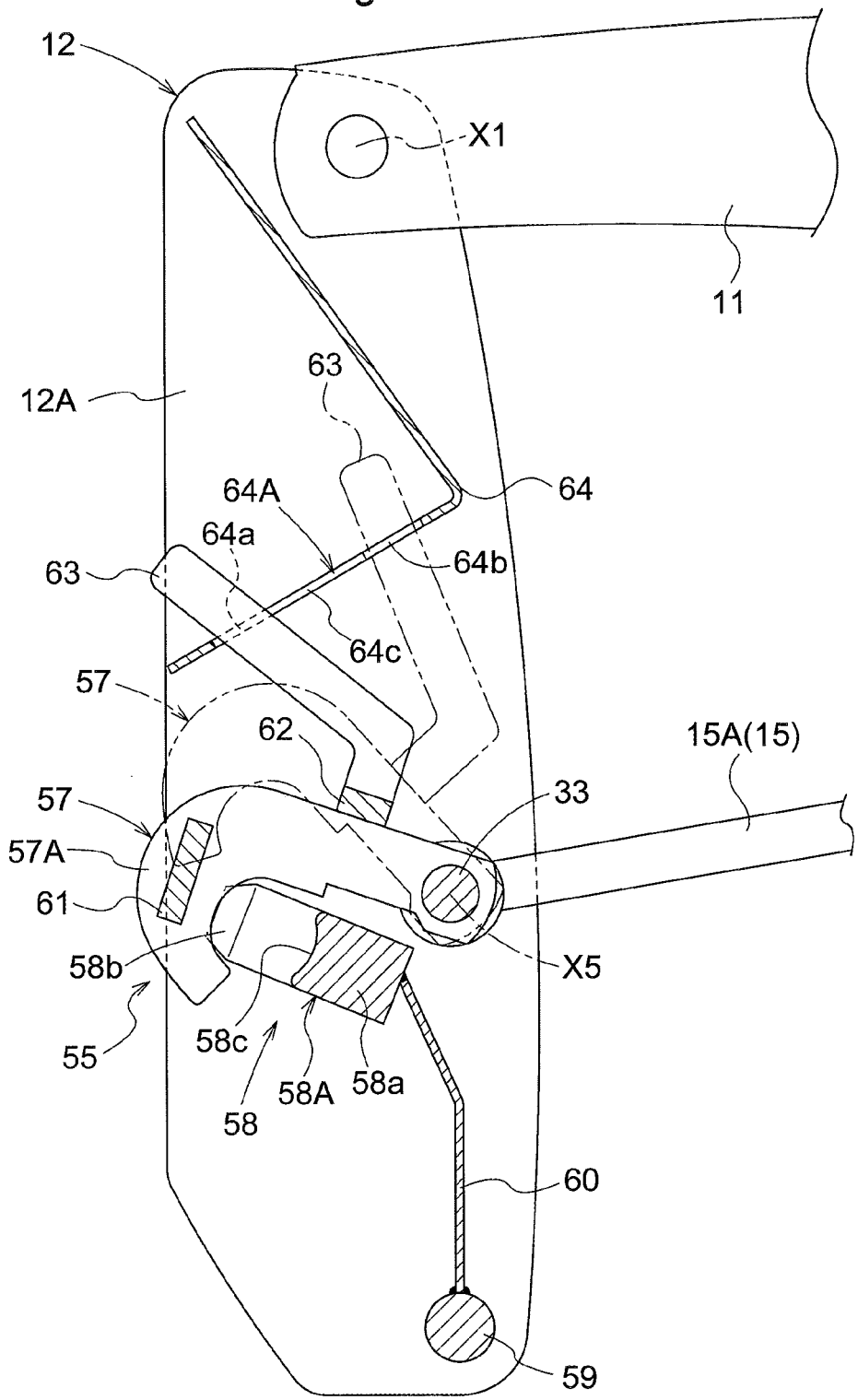
FIG. 14 is a right side view in section showing an inner structure of a side frame.

As shown in FIG. 13 and FIG. 14, the attaching mechanism 55 includes an attaching frame boss portion 56 (corresponding to "an engaged member" relating to the present invention) provided in the attaching frame 1A, a hook 57 (corresponding to "an engaging member" relating to the present invention) provided in the side frame 12 and engageable with the attaching frame boss portion 56, and a stopper 58 (corresponding to "a support member" relating to the present invention) provided in the side frame 12 and capable of supporting the attaching frame boss portion 56.

[Attaching Frame Boss Portion]

The attaching frame boss portion 56 is provided at the upper end portion of the attaching frame 1A to extend through the attaching frame 1A in the vehicle body left-right direction. The left end portion and the right end portion of the attaching frame boss portion 56 project from the attaching frame 1A to the left side and the right side, respectively.

[Hook]

The hook 57 can be switched over between an engaging position (position denoted with the solid line in FIG. 14) for engagement with the attaching frame boss portion 56 and a non-engaging position (position denoted with the two-dotted chain line in FIG. 14) not engaged with the attaching frame boss portion 56. The hook 57 is supported to the side frame 12 via a mount pin 33 to be pivotable about a pivot axis X5 that extends along the vehicle body left-right direction. The hook 57 is accommodated inside the side frame 12. More particularly, the hook 57 is disposed between the pair of left and right side plates 12A.

The hook 57 includes a pair of left and right hook bodies 57A. The pair of left and right hook bodies 57A are connected via connecting bodies 61, 62 to be pivotable in association with each other. The pair of left and right hook bodies 57A are disposed respectively on the left side and right side of the rod 15A side end of the hydraulic cylinder 15. The left hook body 57A can come into engagement with a portion of the attaching frame boss portion 56 which portion projects to the left side from the attaching frame 1A. The right hook body 57A can come into engagement with a portion of the attaching frame boss portion 56 which portion projects to the right side from the attaching frame 1A.

[Stopper]

The stopper 58 includes a pair of left and right stopper bodies 58A. The pair of left and right stopper bodies 58A are fixedly welded respectively to the inner faces of the pair of left and right side plates 12A. The stopper 58 is connected via a connecting plate 60 to a pin 57 provided at the lower end portion of the side frame 12.

Each stopper body 58A includes a receiving portion 58*a* for receiving and supporting the attaching frame boss portion 56 and an inlet portion 58*b* provided on the side opposite (leading end side) the receiving portion 58*a* in the stopper body 58A and configured to receive the attaching frame boss portion 56. The receiving portion 58*a* defines an arc-shaped recess 58*c* along the outer circumferential shape of the attaching frame boss portion 56. The inlet portion 58*b* is tapered so that the distance between the pair of left and right stopper bodies 58A becomes greater as it approaches the leading end thereof. This arrangement results in increase of an opening (distance between the pair of left and right stopper bodies 58A) of the pair of left and right stopper bodies 58A to receive the attaching frame boss portion 56.

[Hook Operational Lever]

A hook operational lever 63 (corresponding to "an operational member" relating to the present invention) manually operably from the driving section 5 is provided for switching over the hook 57 between the engaging position and the non-engaging position. This hook operational lever 63 comprises an elastically deformable plate-like member. The hook operational lever 63 is connected to the connecting body 62. And, this hook operational lever 63 is accommodated inside the side frame 12. More particularly, the hook operational lever 63 is disposed between the pair of left and right side plates 12A.

Figure 15:
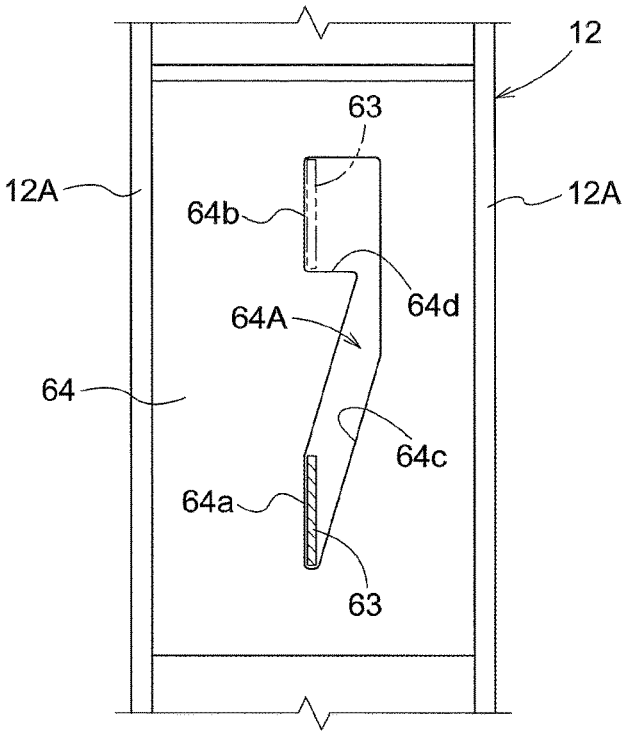
FIG. 15 is a rear view showing a lever guide.

As shown in FIG. 15, the side frame 12 includes a lever guide 64 for the hook operational lever 63. The lever guide 64 is constituted of a plate-like member that is bent appropriately. The lever guide 64 defines a guide groove 64A for guiding the hook operational lever 63. This guide groove 64A includes an engaging position positioning portion 64*a* for fixing the hook operational lever 63 at an engaging operational position corresponding to the engaging position of the hook 57, a non-engaging position positioning portion 64*b* for fixing the hook 57 at a non-engaging operational position corresponding to the non-engaging position of the hook 57, and a tilted guide portion 64*c* extending between the engaging position positioning portion 64*a* and the non-engaging position positioning portion 64*b*. At the non-engaging position positioning portion 64*b*, there is provided a retaining portion 64*d* for hooking and retaining the hook operational lever 63 at the non-engaging operational position.

[Attaching Arrangement of Mount Pin]

Figure 16:
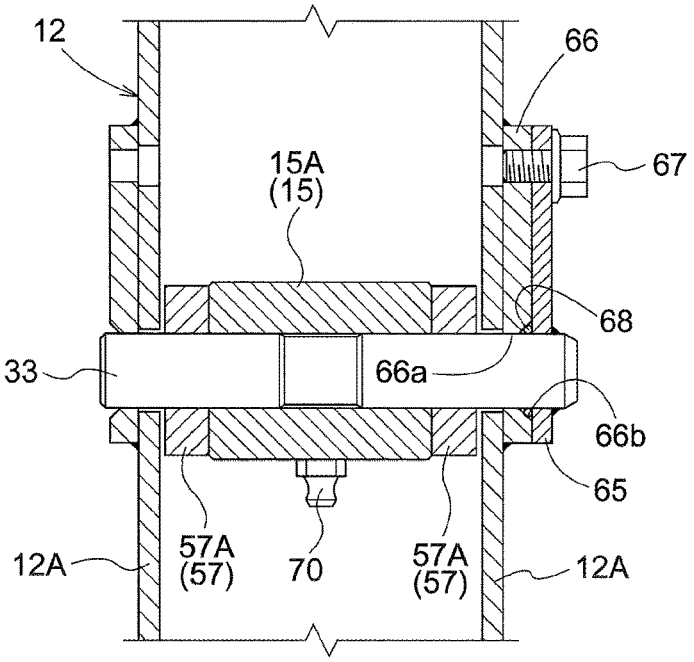
FIG. 16 is a rear view in section showing a pin attaching arrangement.

As shown in FIG. 16, to a portion of the mount pin 33 which portion projects from the side frame 12 to the vehicle body lateral outer side, a fixing plate 65 is fixedly welded. As the fixing plate 65 is fixed by a bolt 67 to a fixed plate 66 provided on the side frame 12 side, rotation and detachment of the mount pin 33 are prevented.

The fixed plate 66 defines an insertion hole 66*a* in which the mount pin 33 is to be inserted. At a portion of the fixed plate 66 corresponding to a vehicle body lateral outer side end portion of the insertion hole 66*a*, a chamfered portion 66*b* is formed. The chamfered portion 66*b* accommodates an O-ring 68 fitted on the mount pin 33. With this arrangement, even if an amount of grease introduced via a grease nipple 70 provided at the rod 15A side end of the hydraulic cylinder 15 attempts to leak to the vehicle body lateral outer side though a gap between the mount pin 33 and the fixed plate 66, such leak of the grease is prevented by the O-ring 68.

[Attachment of Front Loader]

Figure 17:
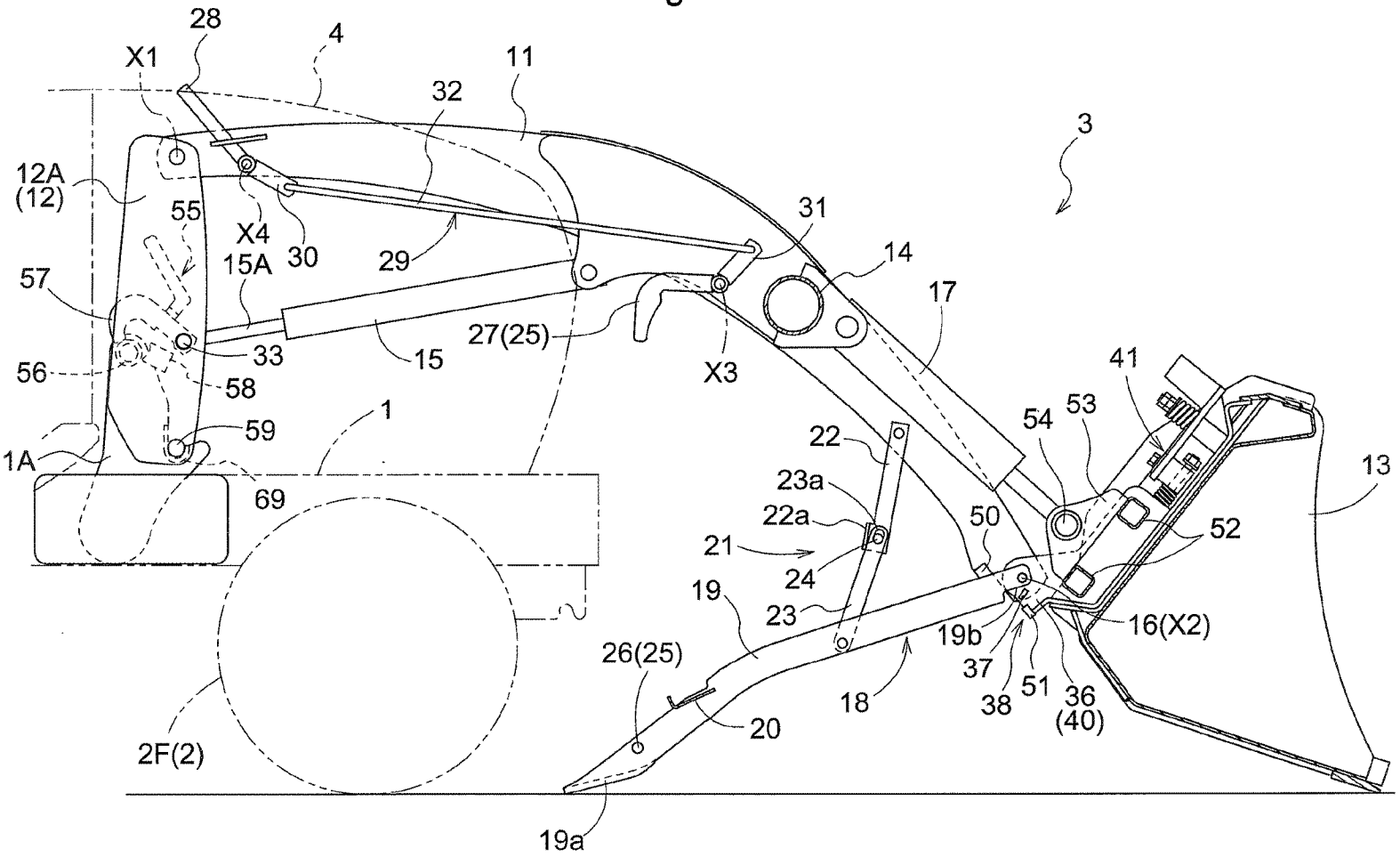
FIG. 17 is a right side view in section showing the front loader when a pin is fitted within a recess.
Figure 18:
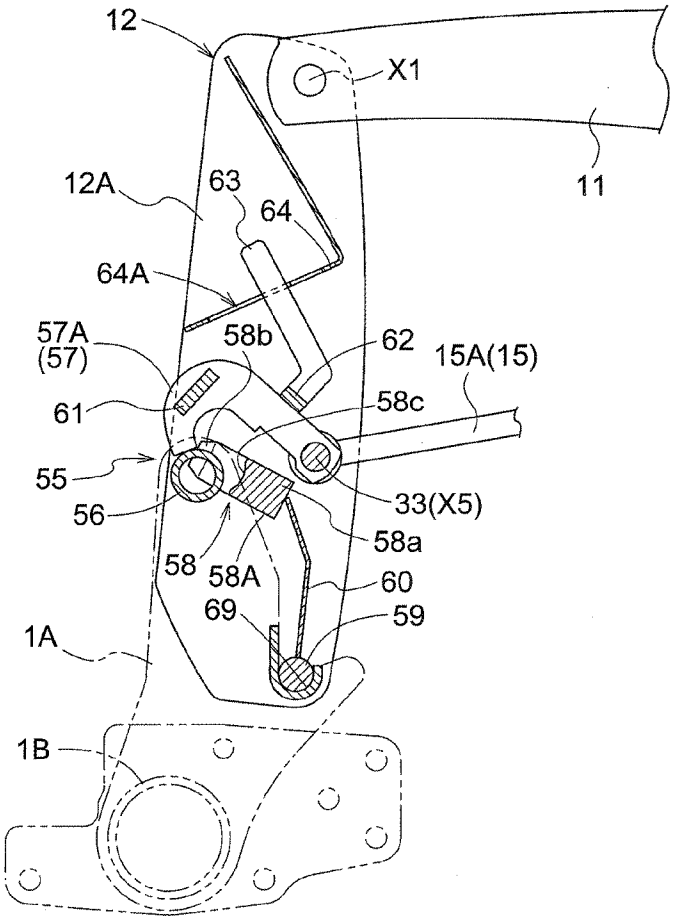
FIG. 18 is an enlarged right side view in section showing the state when the pin is fitted within the recess.

As shown in FIG. 17, starting from the state of the front loader 3 being supported on the stand 18 (the state illustrated in FIG. 4), the bucket 13 is dumped and the pin 59 on the side frame 12 side is fitted in the recess 69 on the attaching frame side 1A. With this, as illustrated in FIG. 18, the attaching frame boss portion 56 will be located at the inlet portion 58*b* of the stopper 58 to come into contact with the hook 57, whereby the hook 57 will be pivoted from the engaging position to the non-engaging position side and also the hook operational lever 63 will be elastically deformed to be pivoted to a mid position in the guide groove 64A on the tilted guide portion 64*c* thereof.

Figure 19:
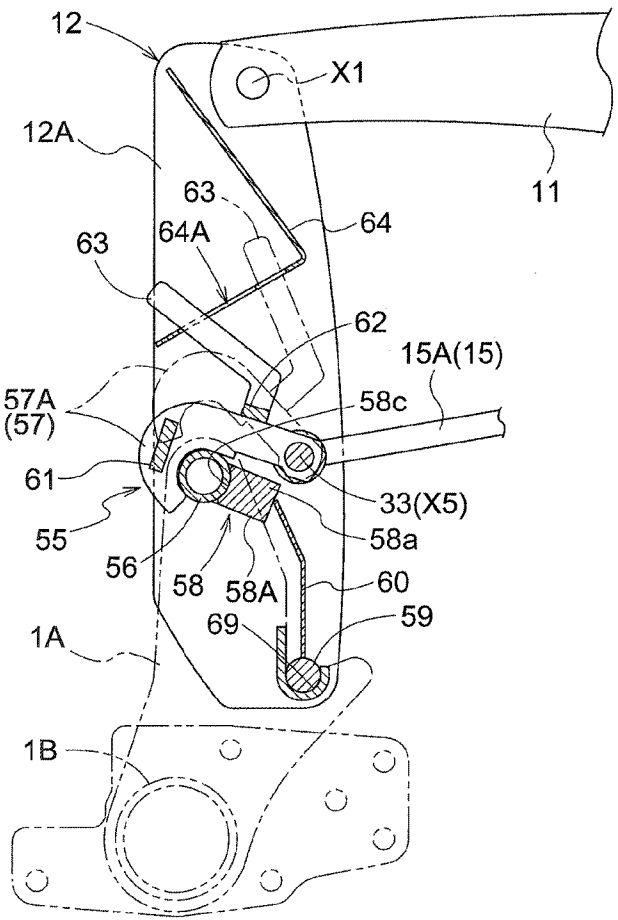
FIG. 19 is an enlarged right side view in section showing a state when a hook is engaged with a boss portion.

And, as shown in FIG. 19, when the side frame 12 is brought to the vertical posture, the hook 57 comes into engagement with the attaching frame boss portion 56. More particularly, the attaching frame boss portion 56 will be fitted into the recess 58*c* of the stopper 58 to be received and supported by the receiving portion 58*a* of the stopper 58 and under this state, the hook 57 comes into engagement with the attaching frame boss portion 56. In the course of this, the hook operational lever 63 will return to its original shape to be pivoted toward the engaging operational position side along the tilted guide portion 64*c* of the guide grove 64A, thus being positioned at the engaging operational position. In this way, as the hook 57 comes into engagement with the attaching frame boss portion 56, the front loader 3 can be attached to the vehicle body.

And, when the front loader 3 is to be detached from the vehicle body, from the driving section 5, the hook operational lever 63 will be switched to the non-engaging operational position and the hook operational lever 63 will be hooked to the retaining portion 64*d* of the guide groove 64A, thus being retained at the non-engaging operational position. With this, the hook 57 is switched to the non-engaging position, so that the front loader 3 can now be detached from the vehicle body.

With the above-described arrangement, only by engaging the hook 57 with the attaching frame boss portion 56, the front loader 3 can be attached to the vehicle body. Namely, as the front loader 3 is attached to the vehicle body without using pins, bolts, or the like, the front loader 3 can be easily attached/detached to/fro the vehicle body.

OTHER EMBODIMENTS (1) The position of the operational lever 28 is not limited to the position relating to the foregoing embodiment. Namely, the operational lever 28 can be provided at any desired position as long as it can be manually operated from the driving section 5. For instance, the operational lever 28 can be provided at the driving section 5 (e.g. at the front panel 7, the vehicle body lateral side of the driver's seat 6, etc.).

(2) In the foregoing embodiment, the "operational tool" relating to the present invention is constituted of the operational lever 28. But, this can be constituted of an operational pedal.

(3) In the foregoing embodiment, the stand lock mechanism 25 is provided between the left stand body 19 and the left boom 11. Alternatively, the mechanism 25 can be provided between the right stand body 19 and the right boom 11. Or, it can be provided respectively in both of these pairs.

Figure 20:
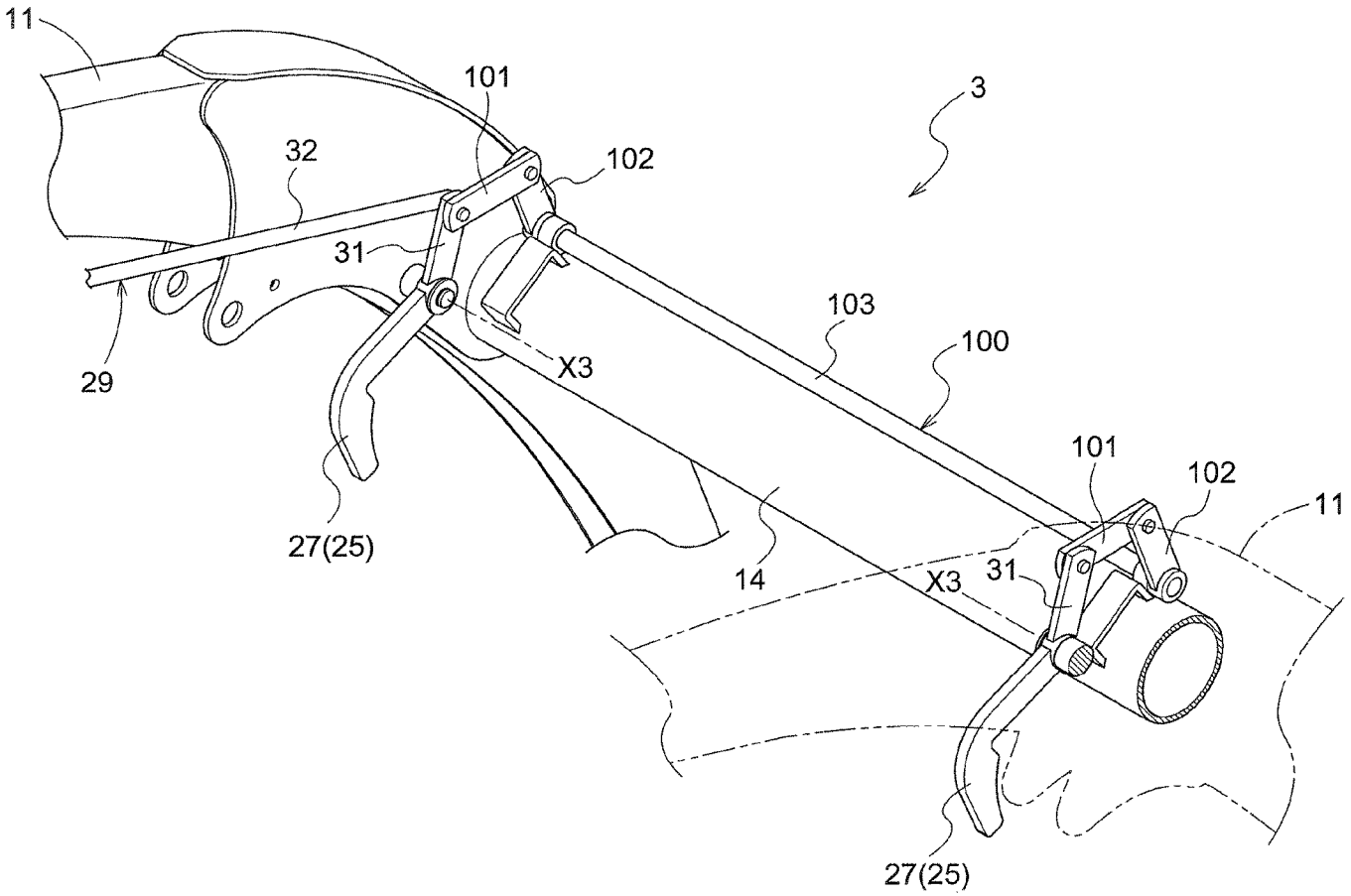
FIG. 20 is a perspective view showing stand lock mechanisms according to a further embodiment.
Figure 21:
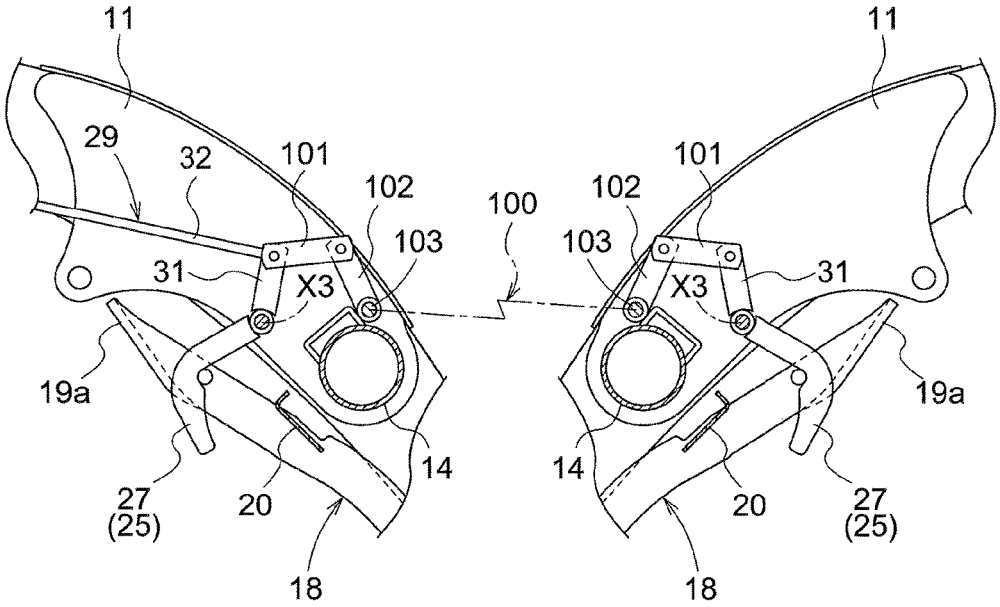
FIG. 21 is a left-right side view in section showing a front loader according to the further embodiment when a stand is stored.
Figure 22:
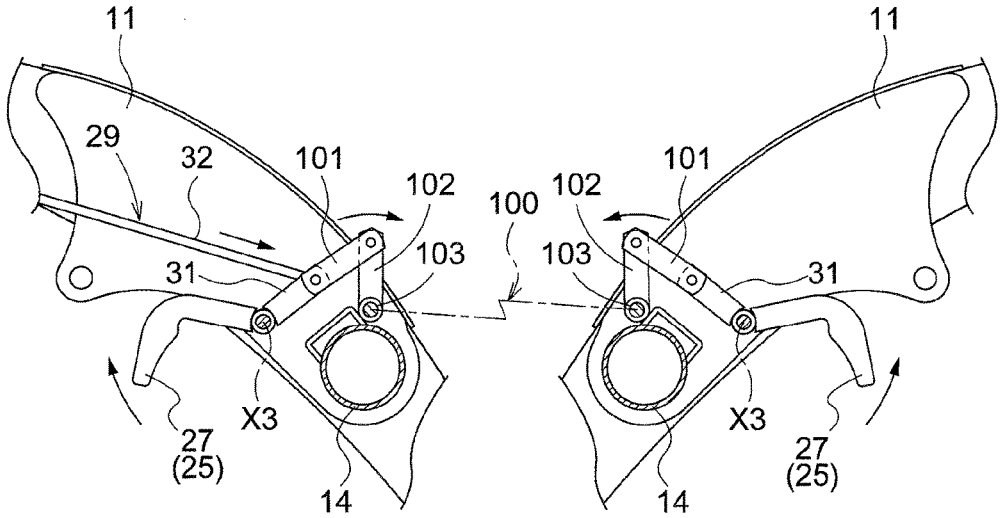
FIG. 22 is a left-right side view in section showing switchover of the stand lock mechanisms of the further embodiment to a lock releasing state.

FIGS. 20 through 22 show an example of arrangement in which stand lock mechanisms 25 are provided between the left stand body 19 and the left boom 11 and also between the right stand body 19 and the right boom 11, respectively. In this embodiment, each stand lock mechanism 25 includes a pin 26 and a hook 27 engageable with the pin 26.

In this embodiment too, there is provided a stand operational lever 28 for switching over the stand lock mechanism 25 between a locking state and a releasing state. The stand operational lever 28 is switchable between a locking position corresponding to the engaging position of the hook 27 and a releasing position corresponding to the non-engaging position of the hook 27 and also can be maintained in position at the locking position and the releasing position, respectively. In this embodiment, the interlocking mechanism 29 includes a second arm 31 on the right hook side, in addition to a second arm 81 on the left hook side. Namely, in this embodiment, the interlocking mechanism 29 includes a pair of left and right second arms 31. The left and right second arms 31 are disposed inside the left and right stand bodies in the vehicle body left-right direction. The left second arm 31 is pivotable together with the left hook 27 and the right second arm 31 is pivotable together with the right hook 27.

Further, in this embodiment, the interlocking mechanism 29 includes a coupling mechanism 100 for operably coupling the left and right hooks 27 to each other. This coupling mechanism 100 includes a pair of left and right third arms 102, a left-right coupling shaft 103 and a pair of left and right link members 101. To a left end of the left-right coupling shaft 103, the left third arm 102 is coupled to be pivotable therewith. To a right end of the left-right coupling shaft 103, the right third arm 102 is coupled to be pivotable therewith. One end of the left link member 101 is pivotally supported to the left second arm 31, and the other end of the left link member 101 is pivotally supported to the left third arm 102. One end of the right link member 101 is pivotally supported to the right second arm 31, and the other end of the right link member 101 is pivotally supported to the right third arm 102. The interlocking mechanism 29 is disposed between the left and right booms 11 in the vehicle body left-right direction.

In this embodiment, in association with an operation of the stand operational lever 28, the left hook 27 is operated like the foregoing embodiment, and in addition, the right hook 27 too is operated. Namely, in association with a operation of the stand operational lever 28, via the left second arm, the left link member 101, the left third arm 102, the left-right coupling shaft 103, the right third arm 102, the right link member 101 and the right second arm 31, the right hook 27 is operated (see FIGS. 21 and 22).

(4) In the foregoing embodiment, the interlocking mechanism 29 is disposed on the vehicle body lateral inner side of the boom 11. Instead, it can be disposed on the vehicle body lateral outer side of the boom 11. Further alternatively, it can be disposed within the boom 11.

Figure 23:
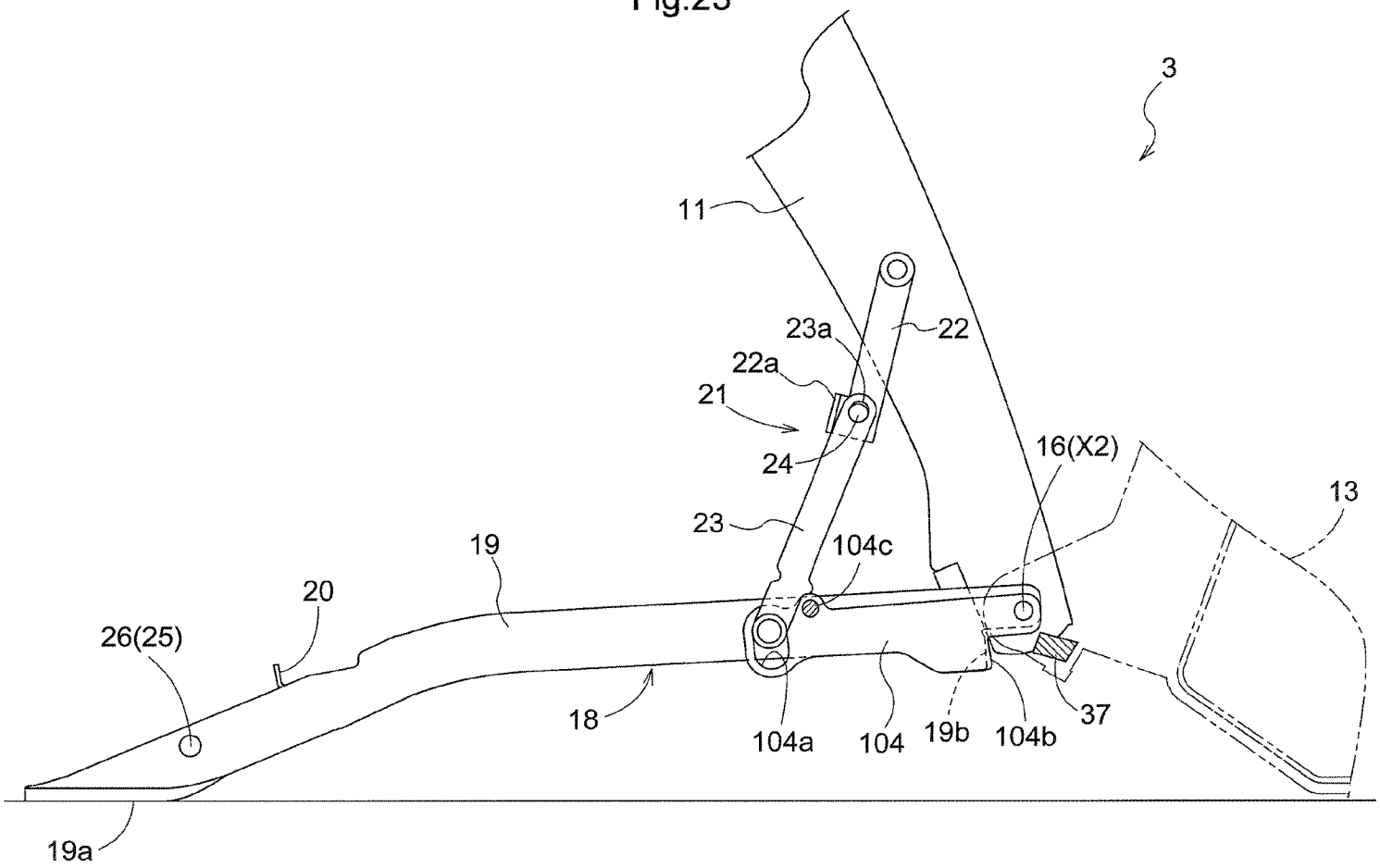
FIG. 23 is a side view showing a link mechanism in the further embodiment.
Figure 24:
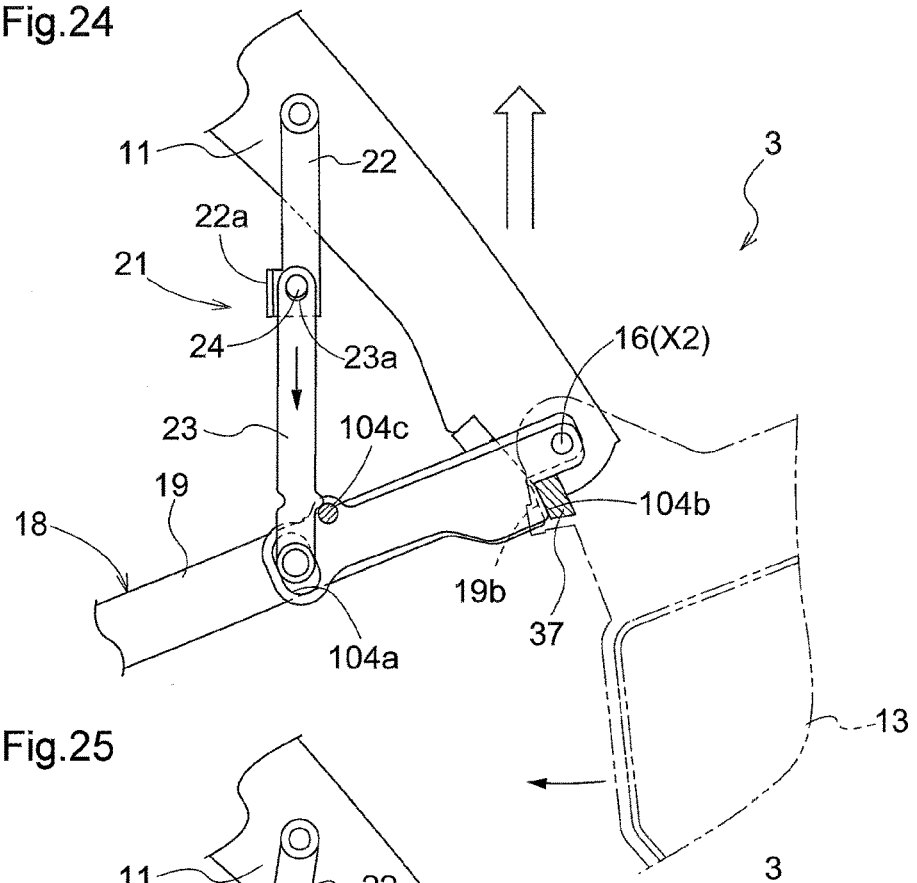
FIG. 24 is a side view showing an operation of the link mechanism in the further embodiment.
Figure 25:
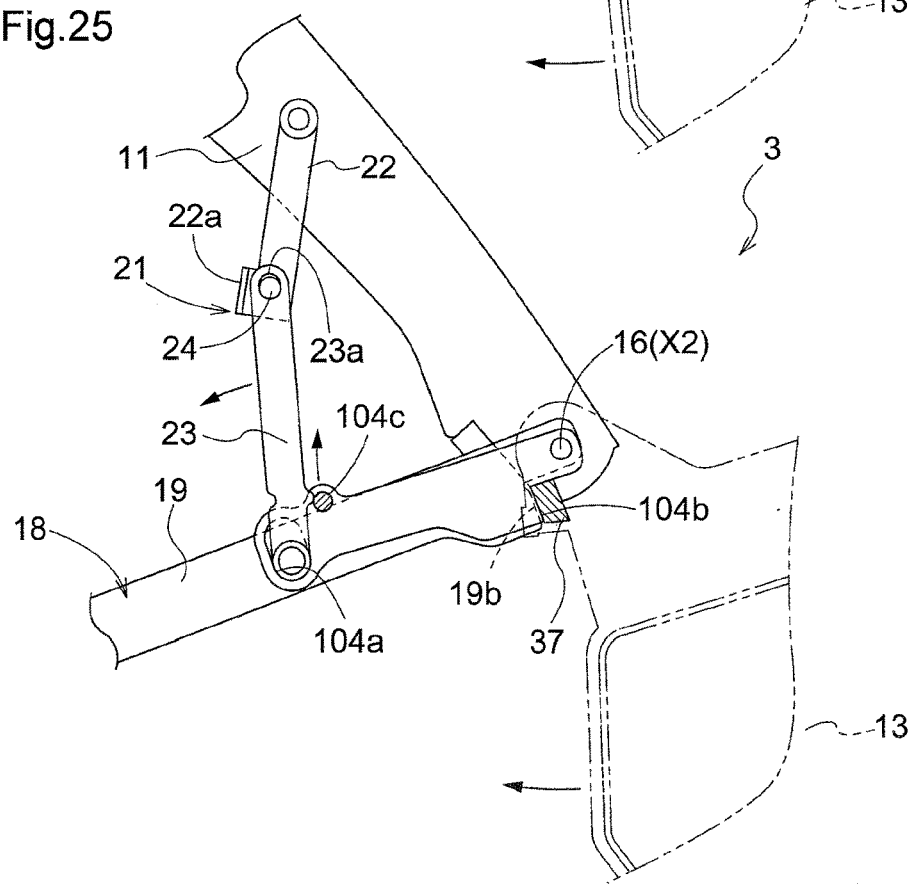
FIG. 25 is a side view showing an operation of the link mechanism in the further embodiment.

(5) In the foregoing embodiment, as shown in FIGS. 23 through 25, the link mechanism 21 can include a third link member 104, in addition to the first link member 22 and the second link member 23. One end of the third link member 104 is supported to be pivotable about the pivot axis X2 of the bucket 13 and the stand 18. Further, at the other end of the third link member 104, an elongate hole 104*a* is formed. And, the other end of the third link member 104 is supported via this elongate hole 104*a* to a pivot support shaft portion 23*a* of the second link member 23 for the stand 18. Namely, the third link member 104 is pivotable about X2 in the range defined by the elongate hole 104*a*.

Moreover, on one end side of the third link member 104, a recess 104*b* is formed and on the other end side of the third link member 104, there is formed a contact portion 104*c* with which the second link member 23 comes into contact. The recess 19*b* and the recess 104*b* are set such that the projection 37 comes into contact with the third link member 104 prior to the stand body 19 when the bucket 13 is dumped.

When the booms 11 are elevated to dump the bucket 13 to a position where the projection 37 enters the recess 19*b* and the recess 104*b*, the projection 37 comes into contact with the third link member 104 firstly (see FIG. 24). With this, the third link member 104 is pivoted in the range of the elongate hole 104*a* and the contact portion 104*c* of the third link member comes into contact with the second link member 23, thus pivoting the link mechanism 21 slightly toward the side of the posture of the stand 18. Thereafter, the projection 37 comes into contact with the base of the stand body 19 and the stand 18 is pivoted toward the stored posture side (see FIG. 25). In this way, since the link mechanism 21 is slightly pivoted toward the posture side of the stand 18 before the projection 37 comes into contact with the base of the stand body 19, the pivotal motion of the stand 18 toward the stored posture can proceed smoothly.

(6) In the foregoing embodiment, the pivot axis X2 of the bucket 13 and the pivot axis X2 of the stand 18 are set on a common axis. Instead, they can be set on different axes.

(7) In the foregoing embodiment, the bucket 13 and the stand 18 are supported to the same support shaft 16. Instead, they can be supported to different members.

(8) In the foregoing embodiment, the recess 19*b* is provided in the stand body 19. But, this can be omitted.

Figure 26:
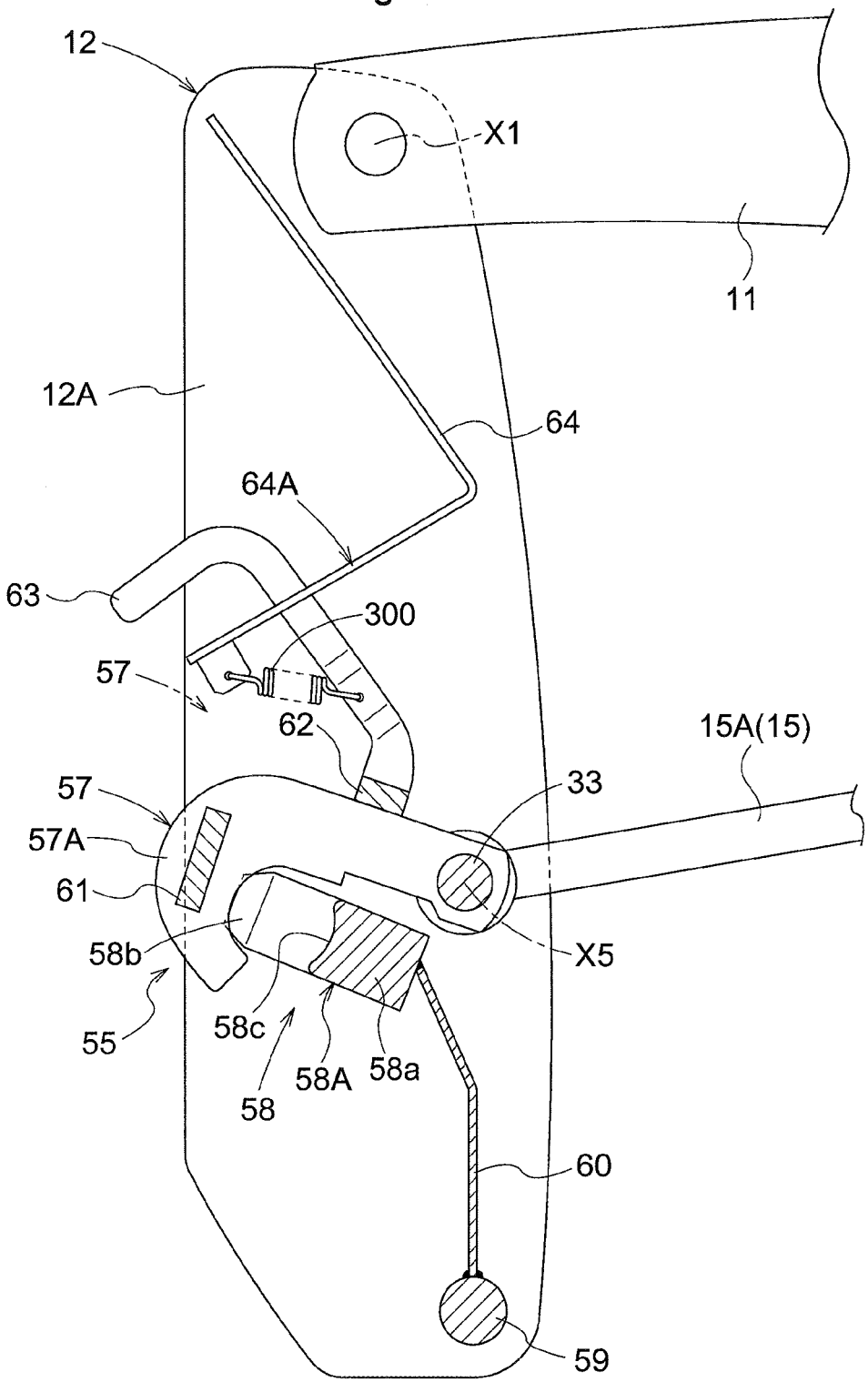
FIG. 26 is a right side view in section showing an inner arrangement of a side frame according to a further embodiment.

(9) In a further embodiment, a hook operational lever 63 (corresponding to the "operational member" relating to the present invention) is urged toward an engaging operational position side. More particularly, as shown in FIG. 26, a spring 300 is provided between the hook operational lever 63 and a portion adjacent the engagement operational position of the lever guide. By this spring, the hook operational lever 63 is urged toward an engaging operational position side. With this arrangement, it is possible to prevent wobble of the hook operational lever 63 due to e.g. vibration at the time of traveling.

Figure 27:
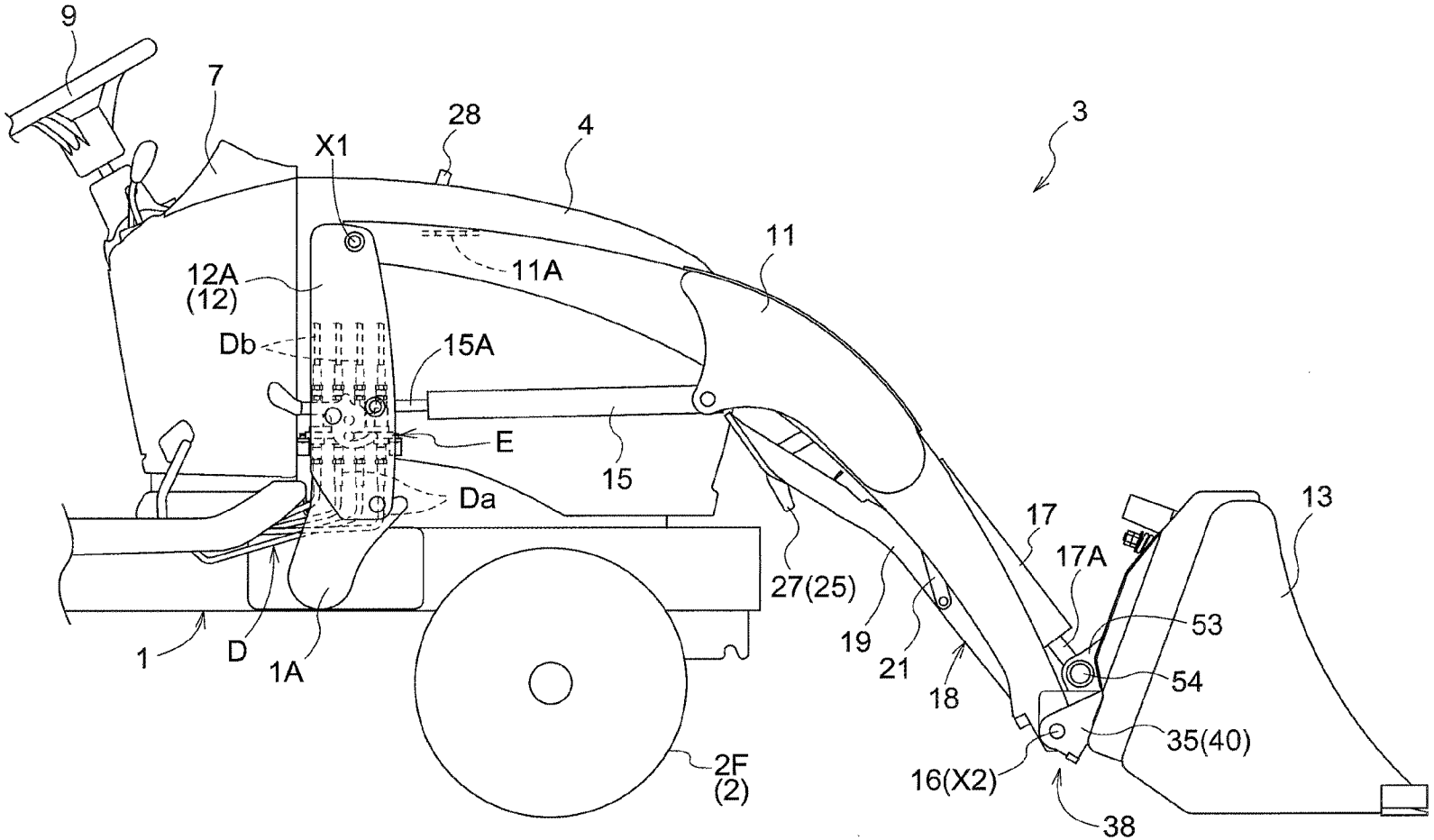
FIG. 27 is a right side view showing a front portion of a tractor in the further embodiment.

(10) In the foregoing embodiment though not explicitly described therein, as shown in FIG. 27, in this type of work vehicle having a front loader, there are provided a plurality (four in this embodiment) of hydraulic pipes D between the tractor body and the front loader 3. At an intermediate portion of the hydraulic pipe D, there is provided a connecting portion E allowing connection and disconnection between a hydraulic pipe on the tractor body side and a pipe on the front loader side.

Figure 28:
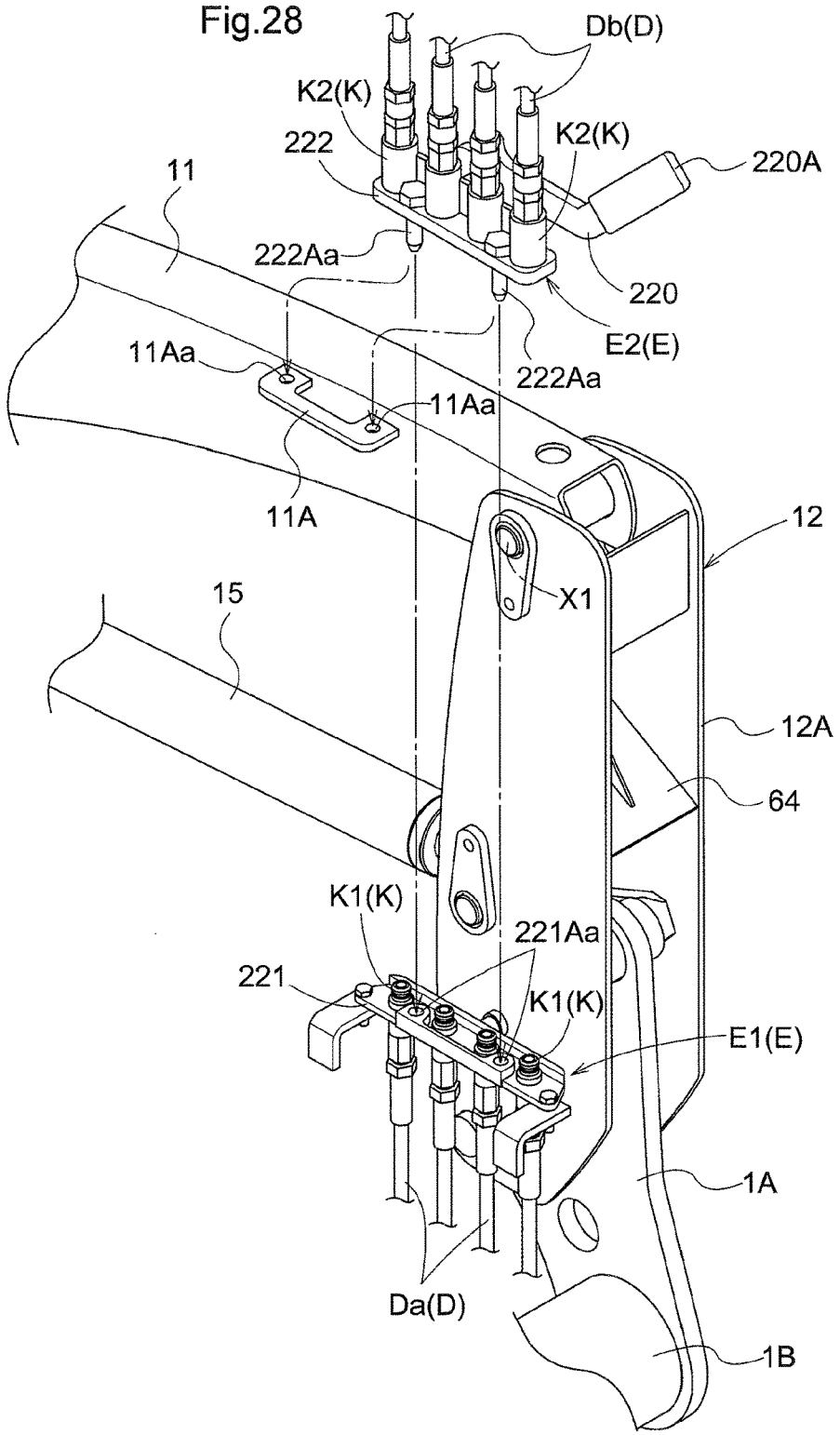
FIG. 28 is a perspective view showing a connecting portion.
Figure 29:
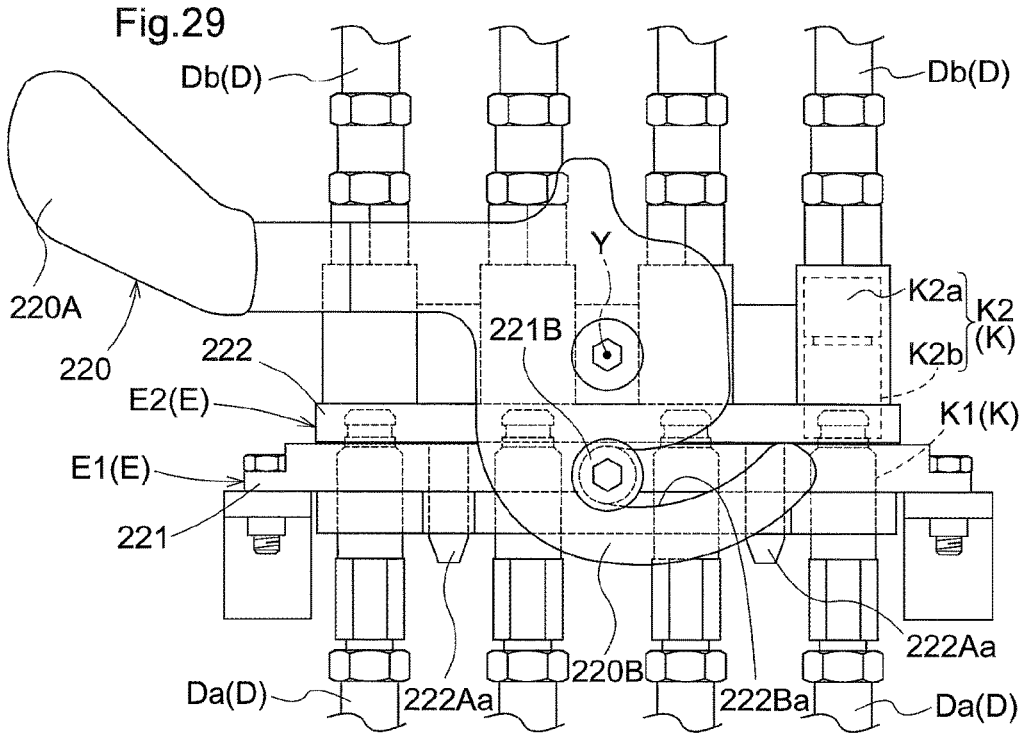
FIG. 29 is a side view showing the connecting portion.
Figure 30:
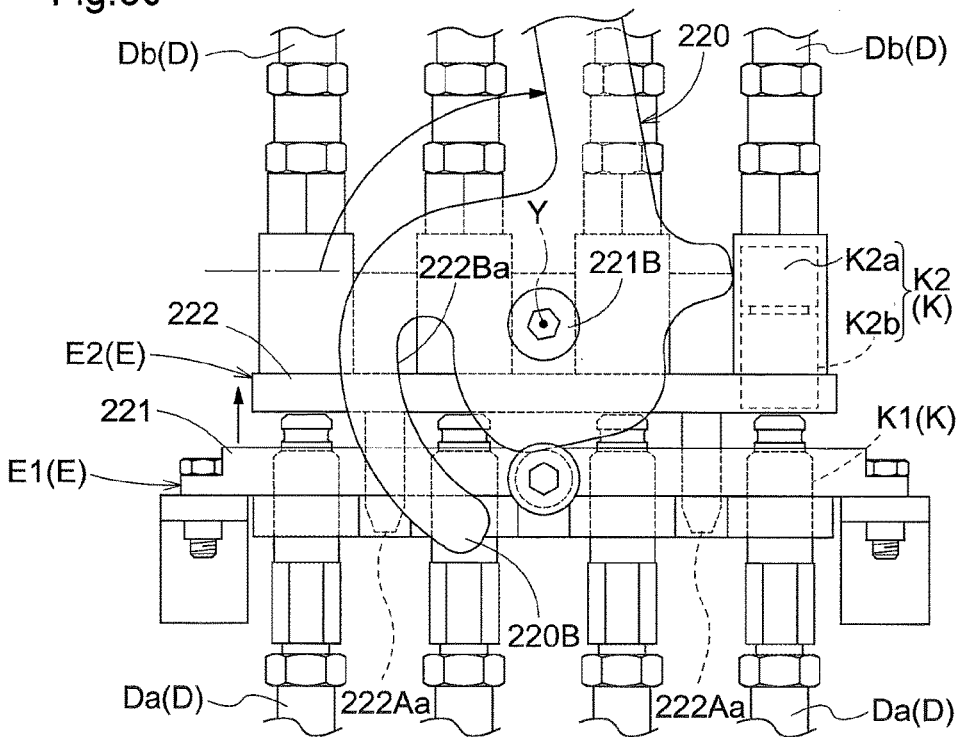
FIG. 30 is a side view showing the connecting portion.

As shown in FIGS. 28 through 30, the connecting portion E comprises an assembly of the respective hydraulic pipes D with allowing their attachment/detachment and includes a handle 220 for effecting an attaching/detaching operation. The specific arrangement of the connecting portion E comprises block bodies that can be separated from each other in the vertical direction. That is, of the block bodies, a lower block body E1 disposed on the lower side is disposed at a lateral side of the rear end side of the hood 4 of the tractor body and fixed under this stat to the vehicle body frame 1.

Further, an upper block body E2 disposed on the upper side includes the above-described handle 220 and under the state thereof combined with the lower block body E1, this upper block body E2 is supported to the vehicle body frame 1 via the lower block body E1. Under its state separated from the lower block body E1, the upper block body E2 can be retained to a retaining portion 11A of the right boom 11, thus being supported to the front loader 3 (see FIG. 28). When the upper block body E2 is to be retained to the retaining portion 11A, a guide bar-like body 222Aa (a second holder member 222) to be described later of the upper block body E2 will be inserted into a hole portion 11Aa formed in the retaining portion 11A.

The lower block body E1 includes four male side couplers K1 of a coupler K and a first holder member 221 that holds in position these respective male side couplers K1 under vertical postures and in spaced relation to each other along the front-rear direction of the tractor body.

To a lower end side of each male side coupler K1, a hydraulic pipe Da (metal pipe) on the tractor body side is communicated and connected, and to an upper end side thereof, a female side coupler K2 of the upper block body E2 is detachably attached.

The first holder member 221 defines guide holes 221Aa, which are provided as two guide holes 221Aa in this embodiment. These guide holes 221Aa are formed for the purpose of placing the upper block body E2 near or distant from the lower block body E1 with keeping a parallel state relative thereto. Namely, by inserting two guide bar-like bodies 222Aa (to be described later) formed in the upper block body E2 into the respective guide holes 221Aa, the upper block body E2 can be guided to follow the lower block body E1, so that the four couplers K can be connected (or disconnected) straight and concurrently. Further, in a lateral portion of the first holder member 221, there is formed an engaging projection 221B. This engaging projection 221B engages with a cutout portion 220Ba to be described later.

The upper block body E2 includes four female side couplers K2 of the coupler K and a second holder member 222 that holds these respective female side couplers K2 under vertical posture and under a condition corresponding to the respective male side couplers K1 described above.

The female side coupler K2 includes a main body portion K2*a* and a projecting/retracting portion K2*b* provided at a lower end portion of the main body portion K2*a*. To an upper end side of the main body portion K2*a*, a hydraulic pipe (a hydraulic hose) on the front loader 3 side is communicated and connected, and to a lower end side thereof, the male side coupler K1 of the lower block body E1 is detachably attached.

The projecting/retracting portion K2*b* is urged to project or retract downwards relative to the main body portion K2*a* and is configured such that in association with connection between the couplers K, when an upper end portion of the male side coupler K1 enters a lower end portion of the female side coupler K2, the projecting/retracting portion K2*b* projects around the male side coupler K1 to be fitted thereon. With this projection and fitting, the connection is locked.

Further, in a disconnecting operation of the couplers K1, the projecting/retracting portion K2*b* fitted on the male side coupler K1 will be pulled up to be retracted and urged toward the main body portion K2*a* side, whereby the locking of the connection is released, so that the hydraulic pipes D can be disconnected.

To a lateral portion of the second holder member 222, a handle 220 that is vertically pivotable about a horizontal axis Y is pivotally connected.

Further, on the second holder member 222, the guide bar-like bodies 222Aa corresponding to the guide holes 221Aa are formed to project downwards respectively. These guide bar-like bodies 222Aa are formed for the purpose of placing the upper block body E2 near or distant from the lower block body E1 with keeping a parallel state relative thereto.

The handle 220 includes a handle main body portion 220A provided on one end side across the pivot (the rear side in the vehicle body front-rear direction) and a connecting operational portion 220B provided on the other side across the pivot (the front side in the vehicle body front-rear direction). The handle main body portion 220A extends rearwards between the hood 4 and a mast 12A. The connecting operational portion 220B defines a cutout 220Ba. When the handle main body portion 220A is pivotally operated, the cutout 220Ba and the engaging projection 221B are engaged/disengaged with/from each other.

In association with a downward pivotal operation of the handle main body portion 220A about the horizontal axis Y, the cutout 220Ba and the engaging projection 221B are engaged with each other and also by a cam action of the lateral face of the cutout 220Ba, the first holder member 221 and the second holder member 222 come closer to each other. With this, the female side couplers K2 supported to the second holder member 222 are pressed downwards (towards the first holder member 221 side).

Further, in association of a pivotal operation of the handle main body portion 230A about the horizontal axis Y, by the cam function of the lateral face of the cutout portion, the first holder member 221 and the second holder member 222 move away from each other (a force for moving the second holder member 222 upwards is applied), whereby the engagement between the cutout portion 220Ba and the engaging projection is released. With the application of the force that moves the second holder member 222 upwards, the projecting/retracting portions K2*b* of the female side couplers K2 supported to the second holder member 222 can be pulled up.

Next, there will be explained a procedure for releasing the connection of the connecting portion E in association with detachment between the tractor body and the front loader 3.

[1] When the upper block body E2 is to be connected to the lower block body E1, as shown in FIG. 28 and FIG. 29, the upper block body E2 will be disposed immediately above the lower block body E1 and then lowered while inserting the guide bar-like bodies 222Aa into the guide holes 221Aa of the first holder member.

[2] The handle 220 will be pivoted downwards, whereby the upper block body E1 is pressed against the lower block body E1, thus enabling connected state of the coupler K, and the hydraulic pipes D can be connected under the communicated state (see FIG. 29).

[3] When the hydraulic pipes D are to be disconnected, as shown in FIG. 30, the handle 20 will be pivoted upwards.

With the above, a pulling-up force is applied to the projecting/retracting portions K2*b* of the female side couplers K2 via the second holder member 22, thus being urged and retracted upwards, whereby the connected locked state of the coupler K is released and the hydraulic pipes D can now be disconnected.

(11) In the foregoing embodiment, the "engaged member" relating to the present invention is constituted of the attaching frame boss portion 56. Alternatively, this can be constituted of a solid round bar-like member, for instance.

(12) In the foregoing embodiment, the hook operational lever 63 is accommodated inside the side frame 12. But, the hook operational lever 63 can be disposed at any desired place as long as it can be manually operated from the driving section 5.

(13) In the foregoing embodiment, the "operational member" relating to the present invention is constituted of the hook operational lever 63 that can be manually operated from the driving section 5. Alternatively, it can be constituted of an operational pedal. Further, this "operational member" can be automatically operable. Or, this "operational member" can be omitted at all. In such case, the hook 57 will be switched over between the engaging position and the non-engaging position directly either manually or automatically.

(14) The guide portion for guiding the attaching frame boss portion 56 to the stopper 58 can be provided in the attaching frame boss portion 56 or in the stopper 58.

(15) In the foregoing embodiment, the "implement" relating to the present invention is constituted of the bucket 13. However, this "implement" is not limited to the bucket 13.

The invention claimed is:

1. A work vehicle comprising:

a front loader including a pair of left and right booms, a bucket supported to free ends of the pair of left and right booms to be pivotable about a bucket pivot axis extending along a vehicle body left-right direction, the front loader being detachably attached to a vehicle body;

a stand pivotally supported to the front loader to be pivotable about a stand pivot axis extending along the vehicle body left-right direction between an in-use posture for supporting the front loader and a stored posture along a longitudinal direction of the booms, the stand being pivoted to the stored posture in association with a dumping motion of the bucket;

a lock mechanism switchable between a locking state for holding the stand under the stored posture and a releasing state for releasing the locking mechanism;

an operational tool comprising one of a lever and a pedal configured to be manually operated by an operator from a vehicle operator portion of the work vehicle in which the operator rides for switching over the lock mechanism to the locking state or the releasing state; and an interlocking mechanism provided for operatively interlocking the lock mechanism with the operational tool, the interlocking mechanism comprising a first arm having a first end pivotally connected to the operational tool and a second end, a linking rod having a first end pivotally connected to the second end of the first arm and a second end, and a second arm having a first end pivotally connected to the second end of the linking rod and a second end pivotally connected to the lock mechanism, wherein when the stand is pivoted to the stored posture in association with the dumping motion of the bucket and the lock mechanism is switched to the locking state, the stand is held under the stored posture by the lock mechanism; and wherein when the lock mechanism is switched to the releasing posture by the operational tool while the stand is held under the stored posture by the locking mechanism, the stand is switched to the in-use posture.

2. The work vehicle according to claim 1, wherein the interlocking mechanism is disposed on a lateral inner side of the booms.

3. The work vehicle according to claim 1, further comprising:

a pair of left and right side frames that support base end portions of the booms such that the booms are pivotable about a boom pivot axis extending along the vehicle body left-right direction and that can be detachably attached to the vehicle body, wherein the operational tool is accommodated within the side frames.

4. The work vehicle according to claim 1, wherein:

a link mechanism between the booms and the stand is provided; and the link mechanism prevents the stand from being pivoted toward the stored posture side when the stand is under the in-use posture.

5. The work vehicle according to claim 4, wherein the link mechanism allows the stand to be pivoted toward the stored posture side in association with the dumping motion of the bucket.

6. The work vehicle according to claim 1, wherein the lock mechanism includes an engaged portion provided in the stand and a hook supported to the booms and configured to be pivotable about a hook pivot axis extending along the vehicle body left-right direction and engageable with the engaged portion.

7. The work vehicle according to claim 1, wherein the bucket pivot axis and the stand pivot axis are set on a same axis.

8. A front loader comprising:

a pair of left and right booms;

a bucket supported to free ends of the pair of left and right booms to be pivotable about a bucket pivot axis extending along a vehicle body left-right direction, the front loader being detachably attached to a vehicle body;

a stand pivotally supported to the front loader to be pivotable about a stand pivot axis extending along the vehicle body left-right direction between an in-use posture for supporting the front loader and a stored posture along a longitudinal direction of the booms, the stand being pivoted to the stored posture in association with a dumping motion of the bucket;

a lock mechanism switchable between a locking state for holding the stand under the stored posture and a releasing state for releasing the locking state;

an operational tool comprising one of a lever and a pedal configured to be manually operated by an operator from a vehicle operator portion of the work vehicle in which the operator rides for switching over the lock mechanism to the locking state or the releasing state; and an interlocking mechanism provided for operatively interlocking the lock mechanism with the operational tool, the interlocking mechanism comprising a first arm having a first end pivotally connected to the operational tool and a second end, a linking rod having a first end pivotally connected to the second end of the first arm and a second end, and a second arm having a first end pivotally connected to the second end of the linking rod and a second end pivotally connected to the lock mechanism, wherein when the stand is pivoted to the stored posture in association with the dumping motion of the bucket and the lock mechanism is switched to the locking state, the stand is held under the stored posture by the lock mechanism; and when the lock mechanism is switched to the releasing posture by the operational tool while the stand is held under the stored posture by the locking mechanism, the stand is switched to the in-use posture.

* * * * *